United States Patent [19]

Bronson et al.

[11] Patent Number: 4,771,465

[45] Date of Patent: Sep. 13, 1988

[54] DIGITAL SPEECH SINUSOIDAL VOCODER WITH TRANSMISSION OF ONLY SUBSET OF HARMONICS

[75] Inventors: Edward C. Bronson, Lafayette, Ind.; Walter T. Hartwell, St. Charles, Ill.; Thomas E. Jacobs, Cicero, Ill.; Richard H. Ketchum, Wheaton, Ill.; Willem B. Kleijn, Batavia, Ill.

[73] Assignee: American Telephone and Telegraph Company, AT&T Bell Laboratories, Murray Hill, N.J.

[21] Appl. No.: 906,424

[22] Filed: Sep. 11, 1986

[51] Int. Cl.[4] ..... G10L 5/00

[52] U.S. Cl. ..... 381/36; 381/37; 381/38; 381/53

[58] Field of Search ..... 381/36–41, 381/53; 364/724

[56] References Cited

U.S. PATENT DOCUMENTS

| | | | |
|---|---|---|---|
| 4,058,676 | 11/1977 | Wilkes et al. | 381/37 |
| 4,304,965 | 12/1981 | Blanton et al. | 364/724 |
| 4,720,861 | 1/1988 | Bertrand | 381/36 |

OTHER PUBLICATIONS

"A Study on the Relationships between Stochastic and Harmonic Coding", Isabel M. Trancoso, Luis B. Almeida and Jose M. Tribolet, ICASSP 1986. pp. 1709–1712.

"A Background for Sinusoid Based Representation of Voice Speech", Jorge S. Marques and Luis B. Almeida, ICASSP 1986, pp. 1233–1236.

"Mid-Rate Coding Based on a Sinusoidal Representation of Speech", Robert J. McAulay and Thomas F. Quartieri, ICASSP 85, vol. 3 of 4, pp. 944–948.

"Variable-Frequency Synthesis: An Improved Harmonic Coding Scheme", Luis B. Almeida and Fernando M. Silva, ICASSP 84, vol. 2 of 3, pp. 27.5.1–27.5.4.

"Magnitude-Only Reconstruction Using a Sinusoidal Speech Model", R. J. McAulay and T. F. Quatieri, IEEE 1984, pp. 27.6.1–27.6.4.

*Primary Examiner*—William M. Shoop, Jr.
*Assistant Examiner*—Brian Young
*Attorney, Agent, or Firm*—John C. Moran

[57] ABSTRACT

A speech analyzer and synthesizer system using a sinusoidal encoding and decoding technique for voiced frames and noise excitation or multipulse excitation for unvoiced frames. For voiced frames, the analyzer transmits the pitch, values for a subset of offsets defining differences between harmonic frequencies and a fundamental frequency, total frame energy, and linear predictive coding, LPC, coefficients. The synthesizer is responsive to that information to determine the harmonic frequencies from the offset information for a subset of the harmonics and to determine the remaining harmonics from the fundamental frequency. The synthesizer then determines the phase for the fundamental frequency and harmonic frequencies and determines the amplitudes of the fundamental and harmonics using the total frame energy and the LPC coefficients. Once the phase and amplitudes have been determined for the fundamental and harmonic frequencies, the synthesizer performs a sinusoidal analysis. In another embodiment, the remaining harmonic frequencies are determined by calculating the theoretical harmonic frequencies for the remaining harmonic frequencies and grouping these theoretical frequencies into groups having the same number as the number of offsets transmitted. The offsets are then added to the corresponding theoretical harmonics of each of the groups of the remaining harmonic frequencies to generate the remaining harmonic frequencies. In a third embodiment, the offset signals are randomly permuted before being added to the groups of theoretical frequencies to generate the remaining harmonic frequencies.

24 Claims, 19 Drawing Sheets

ANALYZER 100

SYNTHESIZER
200
D/A
SEL
SINUSOIDAL GENERATOR
SYNTHESIS FILTER
HARMONIC AMPLITUDE CALCULATOR
SEL
HIGH HRM FREQUENCY CALCULATOR
LOW HRM FREQUENCY CALCULATOR
WHITE NOISE GENERATOR
PULSE GENERATOR
CHANNEL DECODER
V/U
N/M
139
201
215
221
222
220
216
228
210
230
227
229
223
225
224
226
211
212
213
214
203
204
205
206
207
208
218

VOICED PACKET

UNVOICED WITH WHITE NOISE EXCITATION PACKET

UNVOICED WITH PULSE EXCITATION PACKET

INTERPOLATION OF FREQUENCY

INTERPOLATION OF AMPLITUDE

DIGITAL SPEECH SINUSOIDAL VOCODER WITH TRANSMISSION OF ONLY SUBSET OF HARMONICS

This invention was made with Government support under Contract No. MDA 904-85-C-8032 awarded by Maryland Procurement Office. The government has certain rights in this invention.

CROSS-REFERENCE TO RELATED APPLICATION

Concurrently filed herewith and assigned to the same assignees as this application is Bronson, et al., "Digital Speech Vocoder", application Ser. No. 906,523.

TECHNICAL FIELD

Our invention relates to speech processing, and more particularly to digital speech coding and decoding arrangements directed to the replication of speech, utilizing a sinusoidal model for the voiced portion of the speech, using only the fundamental frequency and a subset of harmonics from the analyzer section of the vocoder and an excited linear predictive coding filter for the unvoiced portion of the speech.

PROBLEM

Digital speech communication systems including voice storage and voice response facilities utilize signal compression to reduce the bit rate needed for storage and/or transmission. One known digital speech encoding scheme is disclosed in the article by R. J. McAulay, et al., "Magnitude-Only Reconstruction Using a Sinusoidal Speech Model", Proceedings of IEEE International Conference on Acoustics, Speech, and Signal Processing, 1984., Vol. 2, p. 27.6.1–27.6.4 (San Diego, U.S.A.). This article discloses the use of a sinusoidal speech model for encoding and decoding of both voiced and unvoiced portions of speech. The speech waveform is analyzed in the analyzer portion of a vocoder by modeling the speech waveform as a sum of sine waves. This sum of sine waves comprises the fundamental and the harmonics of the speech wave and is expressed as $$s(n)=\Sigma a_i(n) \sin [\phi_i(n)]. \quad (1)$$

The terms $a_i(n)$ and $\phi_i(n)$ are the time varyirg amplitude and phase of the speech waveform, respectively, at any given point in time. The voice processing function is performed by determining the amplitudes and the phases in the analyzer portion and transmitting these values to a synthesizer portion which reconstructs the speech waveform using equation 1.

The McAulay article discloses the determination of the amplitudes and the phases for all of the harmonics by the analyzer portion of the vocoder and the subsequent transmission of this information to the synthesizer section of the vocoder. By utilizing the fact that the phase is the integral of the instantaneous frequency, the synthesizer section determines from the fundamental and the harmonic frequencies the corresponding phases. The analyzer determines these frequencies from the fast Fourier transform, FFT, spectrum since they appear as peaks within this spectrum by doing simple peak-picking to determine the frequencies and amplitudes of the fundamental and the harmonics. Once the analyzer has determined the fundamental and all harmonic frequencies plus amplitudes, the analyzer transmits that information to the synthesizer.

Since the fundamental and all of the harmonic frequencies plus amplitudes are being transmitted, a problem exists in that a large number of bits per second is required to convey this information from the analyzer to the synthesizer. In addition, since the frequencies and amplitudes are being directly determined solely from peaks within the resulting spectrum, another problem exists in that the FFT calculations performed must be very accurate to allow detection of these peaks resulting in extensive computation.

SOLUTION

The present invention solves the above described problem and deficiencies of the prior art and a technical advance is achieved by provision of a method and structural embodiment in which voice analysis and synthesis is facilitated by determining only the fundamental and a subset of harmonic frequencies in an analyzer and by replicating the speech in a synthesizer by using a sinusoidal model for the voiced portion of speech. This model is constructed using the fundamental and the subset of harmonic frequencies with the remaining harmonic frequencies being determined from the fundamental frequency using computations that give a variance from the theoretical harmonic frequencies. The amplitudes for the fundamental and harmonics are not directly transmitted from the analyzer to the synthesizer; rather, the amplitudes are determined at the synthesizer from the linear predictive coding, LPC, coefficients and the frame energy received from the analyzer. This results in significantly fewer bits being required to transmit information for reconstructing the amplitudes than the direct transmission of the amplitudes.

In order to reduce computation, the analyzer determines the fundamental and harmonic frequencies from the FFT spectrum by finding the peaks and then doing an interpolation to more precisely determine where the peak would occur within the spectrum. This allows the frequency resolution of the FFT calculations to remain low.

Advantageously, for each speech frame the synthesizer is responsive to encoded information that consists of frame energy, a set of speech parameters, the fundamental frequency, and offset signals representing the difference between each theoretical harmonic frequency as derived from the fundamental frequency and a subset of actual harmonic frequencies. The synthesizer is responsive to the offset signals and the fundamental frequency signal to calculate a subset of the harmonic phase signals corresponding to the offset signals and further responsive to the fundamental frequency for computing the remaining harmonic phase signals. The synthesizer is responsive to the frame energy and the set of speech parameters to determine the amplitudes of the fundamental signal, the subset of harmonic phase signals, and the remaining harmonic phase signals. The synthesizer then replicates the speech in response to the fundamental signal and the harmonic phase signals and the amplitudes of these signals.

Advantageously, the synthesizer computes the remaining harmonic frequency signals in one embodiment by multiplying the harmonic number times the fundamental frequency and then varying the resulting frequencies to calculate the remaining harmonic phase signals.

Advantageously, in a second embodiment, the synthesizer generates the remaining harmonic frequency signals by first determining the theoretical harmonic frequency signals by multiplying the harmonic number times the fundamental frequency signal. The synthesizer then groups the theoretical harmonic frequency signals corresponding to the remaining harmonic frequency signals into a plurality of subsets each having the same number of harmonics as the original subsets of harmonic phase signals and then adds each of the offset signals to the corresponding remaining theoretical frequency signals of each of the plurality of subsets to generate varied remaining harmonic frequency signals. The synthesizer then utilizes the varied remaining harmonic frequency signals to calculate the remaining harmonic phase signals.

Advantageously, in a third embodiment, the synthesizer computes the remaining harmonic frequency signals similar to the second embodiment with the exception that the order of the offset signals is permuted before these signals are added to the theoretical harmonic frequency signals to generate varied remaining harmonic frequency signals.

In addition, the synthesizer determines the amplitudes for the fundamental frequency signals and the harmonic frequency signals by calculating the unscaled energy of each of the harmonic frequency signals from the set of speech parameters for each frame and sums these unscaled energies for all of the harmonic frequency signals. The synthesizer then uses the harmonic energy for each of the harmonic signals, the summed unscaled energy, and the frame energy to compute the amplitudes of each of the harmonic phase signals.

To improve the quality of the reproduced speech, the fundamental frequency signal and the computed harmonic frequency signals are considered to represent a single sample in the middle of the speech frame; and the synthesizer uses interpolation to produce continuous samples throughout the speech frame for both the fundamental and harmonic frequency signals. A similar interpolation is performed for the amplitudes of both the fundamental and harmonic frequencies. If the adjacent frame is an unvoiced frame, then the frequency of both the fundamental and the harmonic signals are assumed to be constant from the middle of the voiced frame to the unvoiced frame whereas the amplitudes are assumed to be "0" at the boundary between the unvoiced and voiced frames.

Advantageously, the encoding for frames which are unvoiced includes a set of speech parameters, multipulse excitation information, and an excitation type signal plus the fundamental frequency signal. The synthesizer is responsive to an unvoiced frame that is indicated to be noise-like excitation by the excitation type signal to synthesize speech by exciting a filter defined by the set of speech parameters with noise-like excitation. Further, the synthesizer is responsive to the excitation type signal indicating multipulse to use the multipulse excitation information to excite a filter constructed from the set of speech parameters signals. In addition, when a transition is made from a voiced to an unvoiced frame the set of speech parameters from the voice frame is initially used to set up the filter that is utilized with the designated excitation information during the unvoiced region.

DETAILED DESCRIPTION

Figure 1:
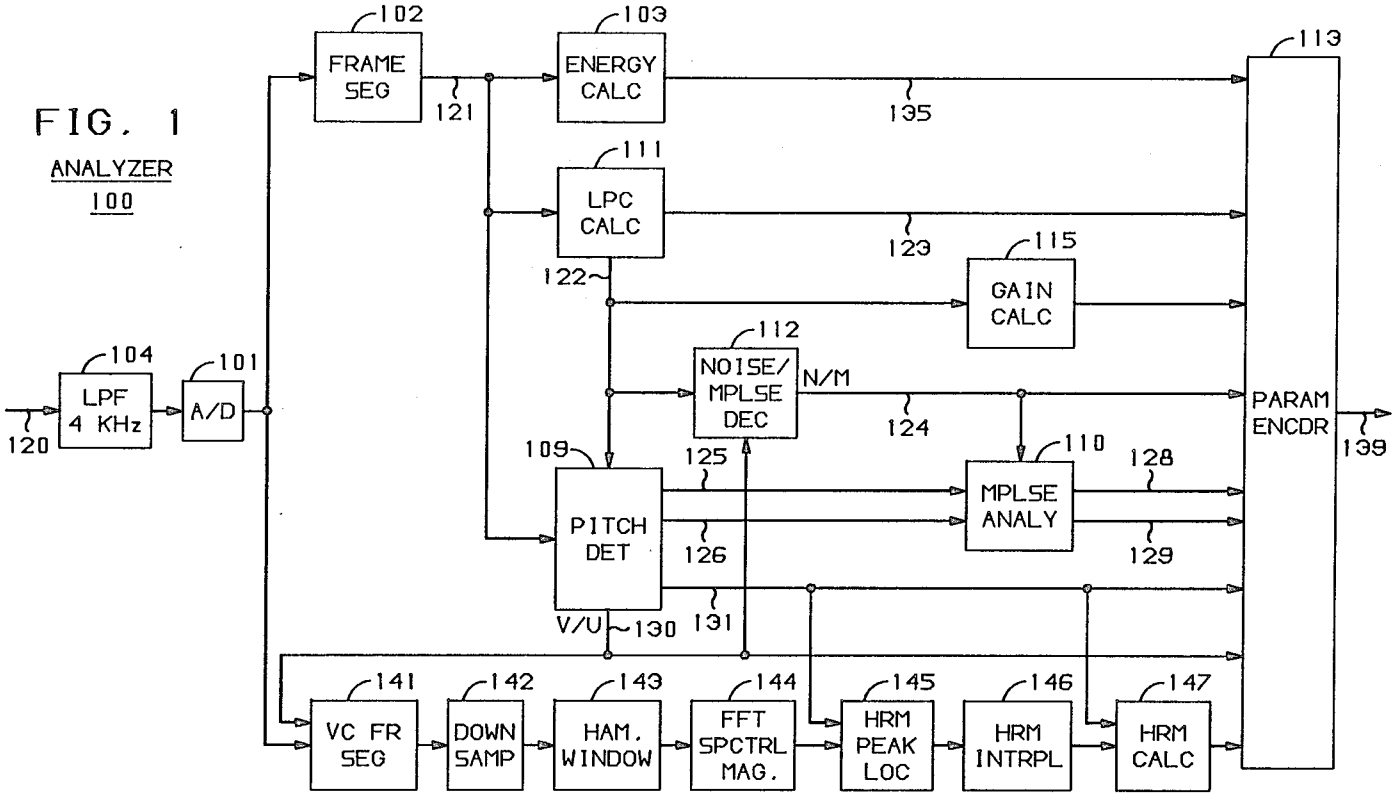
FIG 1 illustrates, in block diagram form, a voice analyzer in accordance with this invention.
Figure 2:
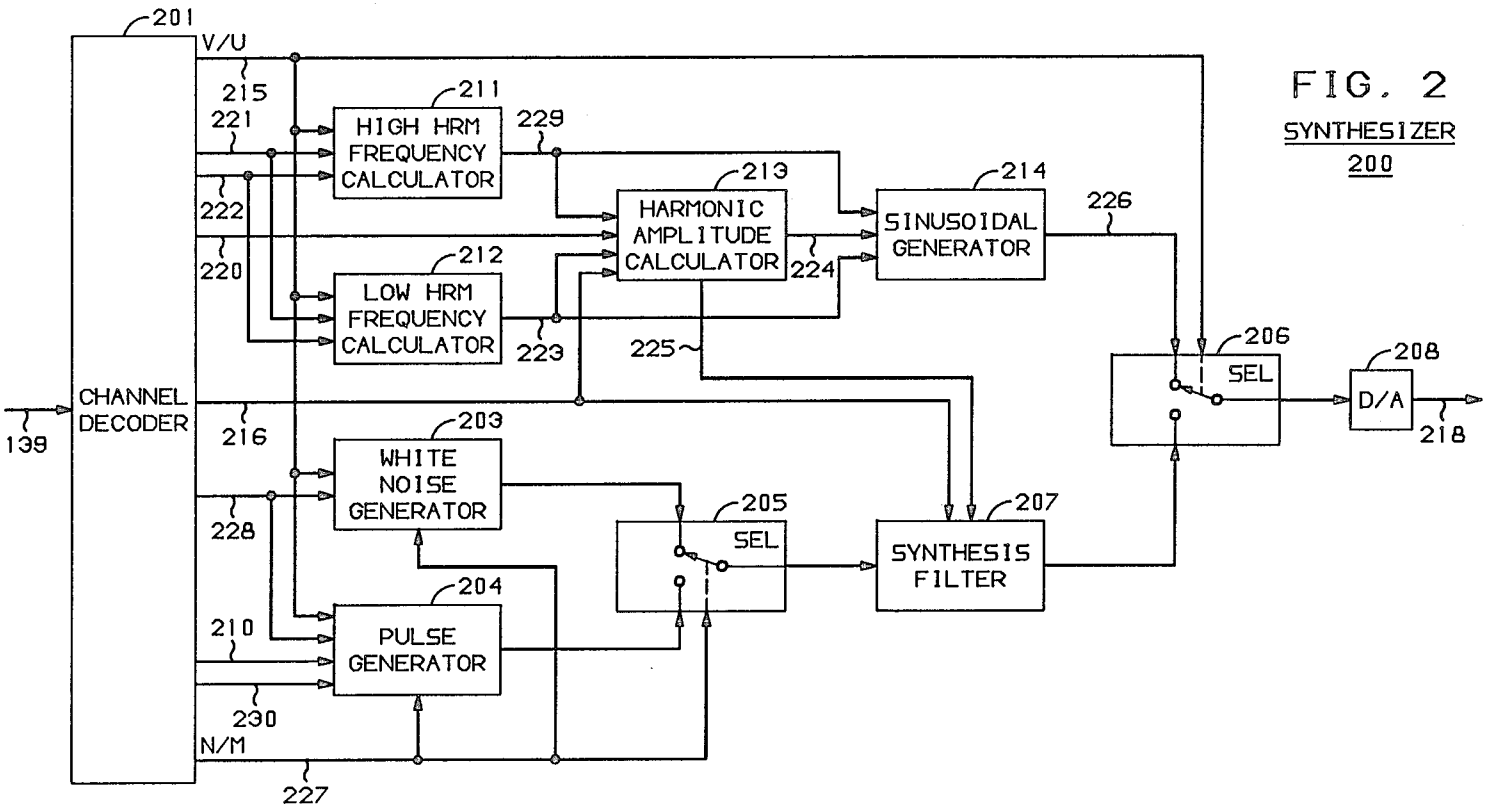
FIG. 2 illustrates, in block diagram form, a voice synthesizer in accordance with this invention.

FIGS. 1 and 2 show an illustrative speech analyzer and speech synthesizer, respectively, which are the focus of this invention. Speech analyzer 100 of FIG. 1 is responsive to analog speech signals received via path 120 to encode these signals at a low-bit rate for transmission to synthesizer 200 of FIG. 2 via channel 139. Advantageously, channel 139 may be a communication transmission path or may be storage media so that voice synthesis may be provided for various applications requiring synthesized voice at a later point in time. Analyzer 100 encodes the voice received via channel 120 utilizing three different encoding techniques. During voiced regions of speech, analyzer 100 encodes information that will allow synthesizer 200 to perform a sinusoidal modeling and reproduction of the speech. A region is classified as voiced if a fundamental frequency is imparted to the air stream by the vocal cords. During unvoiced regions, analyzer 100 encodes information that allows the speech to be replicated in synthesizer 200 by driving a linear predictive coding, LPC, filter with appropriate excitation. The type of excitation is determined by analyzer 100 for each unvoiced frame. Multipulse excitation is encoded and transmitted to synthesizer 200 by analyzer 100 during unvoiced regions that contain plosive consonants and transitions between voiced and unvoiced speech regions which are, nevertheless, classified as unvoiced. If multipulse excitation is not encoded for an unvoiced frame, then analyzer 100 transmits to synthesizer 200 a signal indicating that white noise excitation is to be used to drive the LPC filter.

The overall operation of analyzer 100 is now described in greater detail. Analyzer 100 processes the digital samples received from analog-to-digital converter 101 in terms of frames, segmented by frame segmenter 102 and with each frame advantageously consisting of 180 samples. The determination of whether a frame is voiced or unvoiced is made in the following manner. LPC calculator 111 is responsive to the digitized samples of a frame to produce LPC coefficients that model the human vocal tract and residual signal. The formation of these latter coefficients and energy may be performed according to the arrangement disclosed in U.S. Pat. No. 3,740,476, issued to B. S. Atal, June 19, 1973, and assigned to the same assignees as this application, or in other arrangements well known in the art. Pitch detector 109 is responsive to the residual signal received via path 122 and the speech samples receive via path 121 from frame segmenter block 102 to determine whether the frame is voiced or unvoiced. If pitch detector 109 determines that a frame is voiced, then blocks 141 through 147 perform a sinusoidal encoding of the frame. However, if the decision is made that the frame is unvoiced, then noise/multipulse decision block 112 determines whether noise excitation or multipulse excitation is to be utilized by synthesizer 200 to excite the filter defined by the LPC coefficients that are also calculated by LPC calculator block 111. If noise excitation is to be used, then this fact is transmitted via parameter encoding block 113 to synthesizer 200. However, if multipulse excitation is to be used, block 110 determines a pulse train location and amplitudes and transmits this information via paths 128 and 129 to parameter encoding block 113 for subsequent transmission to synthesizer 200 of FIG. 2.

Figure 3:
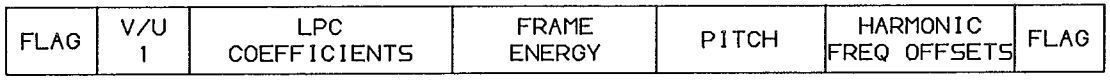
FIG. 3 illustrates a packet containing information for replicating speech during voiced regions.
Figure 4:
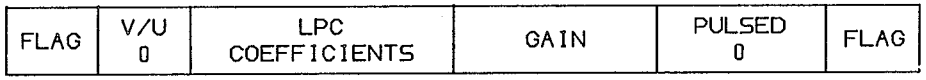
FIG. 4 illustrates a packet containing information for replicating speech during unvoiced regions utilizing noise excitation.
Figure 5:
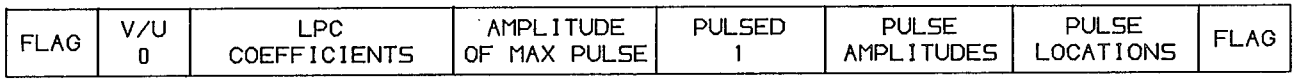
FIG. 5 illustrates a packet containing information for replicating voice during unvoiced regions utilizing pulse excitation.

If the communication channel between analyzer 100 and synthesizer 200 is implemented using packets, than a packet transmitted for a voiced frame is illustrated in FIG. 3, a packet transmitted during the unvoiced frame utilizing white noise excitation is illustrated in FIG. 4, and a packet transmitted during an unvoiced frame utilizing multipulse excitation is illustrated in FIG. 5.

Consider now the operation of analyzer 100 in greater detail for unvoiced frames. Once pitch detector 109 has signaled via path 130 that the frame is unvoiced, noise/multipulse decision block 112 is responsive to this signal to determine whether noise or multipulse excitation is to be utilized. If multipulse excitation is utilized, the signal indicating this fact is transmitted to multipulse analyzer block 110 via path 124. The latter analyzer is responsive to that signal on path 124 and two sets of pulses transmitted via paths 125 and 126 from pitch detector 109. Multipulse analyzer block 110 transmits the locations of the selected pulses along with the amplitude of the selected pulses to parameter encoder 113. The latter encoder is also responsive to the LPC coefficients received via path 123 from LPC calculator 111 to form the packet illustrated in FIG. 5.

If noise/multipulse decision block 112 determines that noise excitation is to be utilized, it indicates this fact by transmitting a signal via path 124 to parameter encoder 113. The latter encoder is responsive to this signal to form the packet illustrated in FIG. 4 utilizing the LPC coefficients from block 111 and the gain as calculated from the residue signal by block 115. More detail concerning the operation of analyzer 100 during unvoiced frames is described in the patent application of D. P. Prezas, et al., Case 6-1 "Voice Synthesis Utilizing Multi-Level Filter Excitation", Ser. No. 770,631, Filed Aug. 28, 1985, and assigned to the same assignees as this application.

Consider now in greater detail the operation of analyzer 100 during a voiced frame. During such a frame, FIG. 3 illustrates the information that is transmitted from analyzer 100 to synthesizer 200. The LPC coefficients are generated by LPC calculator 111 and transmitted via path 123 to parameter encoder 113; and the indication of the fact that the frame is voiced is transmitted from pitch detector 109 via path 130. The fundamental frequency of the voiced region which is transmitted as a pitch period via path 131 by pitch detector 109. Parameter encoder 113 is responsive to the period to convert it to the fundamental frequency before transmission on channel 139. The total energy of speech within frame, eo, is calculated by energy calculator 103. The latter calculator generates eo by taking the square root of the summation of the digital samples squared. The digital samples are received from frame segmenter 102 via path 121, and energy calculator 103 transmits the resulting calculated energy via path 135 to parameter encoder 113.

Figure 6:
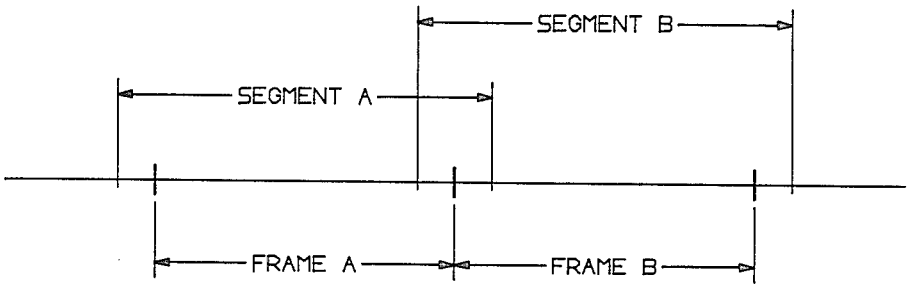
FIG. 6 illustrates the manner in which voice frame segmenter 141 of FIG. 1 overlaps speech frames with segments.

Each frame, such as frame A illustrated in FIG. 6, consists of advantageously 180 samples. Voice frame segmenter 141 is responsive to the digital samples from analog-to-digital converter 101 to extract segments of data samples with each segment overlapping a frame as illustrated in FIG. 6 by segment A and frame A. A segment may advantageously comprise 256 samples. The purpose of overlapping the frames before performing the sinusoidal analysis is to provide more information at the endpoints of the frames. Down sampler 142 is responsive to the output of voiced frame segmenter 141 to select every other sample of the 256 sample segment, resulting in a group of samples having advantageously 128 samples. The purpose of this down sampling is to reduce the complexity of the calculations which are performed by blocks 143 and 144.

Hamming window block 143 is responsive to data from block 142, $s_n$, to perform the windowing operation as given by the following equation:

$$s_n^h = s_n(0.54 - 0.46\cos((2\pi n)/127)),\ 0 \leqq n \leqq 127. \quad (2)$$

The purpose of the windowing operation is to eliminate disjointness at the end points of a frame and to improve spectral resolution. After the windowing operation has been performed, block 144 first pads zeros to the resulting samples from block 143. Advantageously, this padding results in a new sequence of 256 data points as defined in the following equation:

$$s^p = \{s_0^h s_1^h \ldots s_{127}^h\, 0_{128}\, 0_{129} \ldots 0_{255}\}. \quad (3)$$

Next, block 144 performs the discrete Fourier transform, which is defined by the following equation:

$$F_k = \sum_{n=0}^{255} s_n^p\, e^{-j(2\pi/256)nk},\ 0 \leqq k \leqq 255, \quad (4)$$

where $s_n^p$ is the nth point of the padded sequence $s^p$. The evaluation of equation 4 is done using fast Fourier transform method. After performing the FFT calculations, block 144 then obtains the spectrum, S, by calculating the magnitude squared of each complex frequency data point resulting from the calculation performed in equation 4; and this operation is defined by the following equation:

$$S_k = F_k F_k^*, 0 \leqq k \leqq 255, \quad (5)$$

where * indicates complex conjugate.

Harmonic peak locator 145 is responsive to the pitch period calculated by pitch detector 109 and the spectrum calculated by block 144 to determine the peaks within the spectrum that correspond to the first five harmonics after the fundamental frequency. This searching is done by utilizing the theoretical harmonic frequency which is the harmonic number times the fundamental frequency as a starting point in the spectrum and then climbing the slope to the highest sample within a predefined distance from the theoretical harmonic.

Since the spectrum is based on a limited number of data samples, harmonic interpolator 146 performs a second order interpolation around the harmonic peaks determined by harmonic peak locator 145. This adjusts the value determined for the harmonic so that it more closely represents the correct value. The following equation defines this second order interpolation used for each harmonic:

$$P_k = \frac{1}{M} - \frac{S(q+1) - S(q-1)}{2M\,(S(q+1) - 2S(q) + S(q-1))}, \quad (6)$$

where

M is equal to 256.

S(q) is the sample point closer to the located peak, and the harmonic frequency equals $P_k$ times the sampling frequency.

Harmonic calculator 147 is responsive to the adjusted harmonic frequencies and the pitch to determine the offsets between the theoretical harmonics and the calculated harmonic peaks. These offsets are then transmitted to parameter encoder 113 for subsequent transmission to synthesizer 200.

Synthesizer 200 is illustrated in FIG. 2 and is responsive to the vocal tract model and excitation information or sinusoidal information received via channel 139 to produce a replica of the original analog speech that has been encoded by analyzer 100 of FIG. 1. If the received information specifies that the frame is voiced, blocks 211 through 214 perform the sinusoidal synthesis to recreate the original voiced frame information in accordance with equation 1 and this reconstructed speech is then transferred via selector 206 to digital-to-analog converter 208 which converts the received digital information to an analog signal.

If the encoded information received is designated as unvoiced, then either noise excitation or multipulse excitation is used to drive synthesis filter 207. The noise/multipulse, N/M, signal transmitted via path 227 determines whether noise or multipulse excitation is utilized and also operates selector 205 to transmit the output of the designated generator 203 or 204 to synthesis filter 207. Synthesis filter 207 utilizes the LPC coefficients in order to model the vocal tract. In addition, if the unvoiced frame is the first frame of an unvoiced region, then the LPC coefficients from the subsequent voiced frame are obtained by path 225 and are utilized to initialize synthesis filter 207.

Consider further the operations performed upon receipt of a voiced frame. After a voiced information packet has been received, as illustrated in FIG. 3, channel decoder 201 transmits the fundamental frequency (pitch) via path 221 and harmonic frequency offset information via path 222 to low harmonic frequency calculator 212 and to high harmonic frequency calculator 211. The speech frame energy, eo, and the LPC coefficients are transmitted to harmonic amplitude calculator 213 via paths 220 and 216, respectively. The voiced/unvoiced, V/U, signal is transmitted to harmonic frequency calculators 211 and 212. The V/U signal being equal to a "1" indicates that the frame is voiced. Low harmonic frequency calculator 212 is responsive to the V/U equaling a "1" to calculate the first five harmonic frequencies in response to the fundamental frequency and harmonic frequency offset information. The latter calculator then transfers the first five harmonic frequencies to blocks 213 and 214 via path 223.

High harmonic frequency calculator 211 is responsive to the fundamental frequency and the V/U signal to generate the remaining harmonic frequencies of the frame and to transmit these harmonic frequencies to blocks 213 and 214 via path 229.

Harmonic amplitude calculator 213 is responsive to the harmonic frequencies from calculators 212 and 211, the frame energy information received via path 220, and the LPC coefficients received via path 216 to calculate the amplitudes of the harmonic frequencies. Sinusoidal generator 214 is responsive to the frequency information received from calculators 211 and 212 to determine the harmonic phase information and then use this phase information and the harmonic amplitudes received from calculator 213 to perform the calculations indicated by equation 1.

If channel decoder 201 receives a noise excitation packet such as illustrated in FIG. 4, channel decoder 201 transmits a signal, via path 227, causing selector 205 to select the output of white noise generator 203 and a signal, via path 215, causing selector 206 to select the output of synthesis filter 207. In addition, channel decoder 201 transmits the gain to white noise generator 203 via path 228. The gain is generated by gain calculator 115 of analyzer 100 as illustrated in FIG. 1. Synthesis filter 207 is responsive to the LPC coefficients received from channel decoder 201 via path 216 and the output of white noise generator 203 received via selector 205 to produce digital samples of speech.

If channel decoder 201 receives from channel 139 a pulse excitation packet, as illustrated in FIG. 5, the latter decoder transmits the locations and amplitudes of the received pulses to pulse generator 204 via path 210. In addition, channel decoder 201 conditions selector 205 via path 227, to select the output of pulse generator 204 and transfer this output to synthesis filter 207. Synthesis filter 207 and digital-to-analog converter 208 then reproduce the speech. Converter 208 has a self-contained low-pass filter at the output of the converter. Further information concerning the operation of blocks 203, 204, and 207 can be found in the aforementioned patent application of D. P. Prezas, et al.

Consider now in greater detail the operations of blocks 211, 212, 213, and 214 in performing the sinusoidal synthesis of voiced frames. Low harmonic frequency calculator 212 is responsive to the fundamental frequency, Fr, received via path 221 to determine a subset of harmonic frequencies which advantageously is 5 by utilizing the harmonic offsets, $ho_i$, received via path 222. The theoretical harmonic frequency, $ts_i$, is obtained by simply multiplying the order of the harmonic times the fundamental frequency. The following equation defines the ith harmonic frequency for each of the harmonics.

$$hf_i = ts_i + ho_i\ fr,\ 1 \leqq i \leqq 5,$$

where fr is the frequency resolution between spectral sample points.

Calculator 211 is responsive to the fundamental frequency, Fr, to generate the harmonic frequencies, $hf_i$, where $i \geqq 6$ by using the following equation:

$$hf_i = iFr,\ 6 \leqq i \leqq h, \tag{7}$$

where h is maximum number of harmonics in the present frame.

An alternative embodiment of calculator 211 is responsive to the fundamental frequency to generate the harmonic frequencies greater than the 5th harmonic using the equation:

$$hf_i = na,\ 6 \leqq i \leqq h, \tag{8}$$

where h is maximum number of harmonics and a is the frequency resolution allowed in the synthesizer. Advantageously, variable a can be chosen to be 2Hz. The integer number n for the ith frequency is found by minimizing the expression $$(iFr - na)^2 \tag{9}$$

where iFr represents the ith theoretical harmonic frequency. Thus, a varying pattern of small offsets is generated.

Another embodiment of calculator 211 is responsive to the fundamental frequency and the offsets for advantageously the first 5 harmonic frequencies to generate the harmonic frequencies greater than advantageously the 5th harmonic by adding the offsets to the theoretical harmonic frequencies for the remaining harmonics by grouping the remaining harmonics in groups of five and adding the offsets to those groups. The groups are $\{k_1+1, \ldots 2k_1\}$, $\{2k_1+1, \ldots 3k_1\}$, etc. where advantageously $k_l = 5$. The following equation defines this embodiment for a group of harmonics indexed from $mk_1+1$ through $(m+1)k_1$:

$$hf_j = jFr + ho_j$$

where $\{ho_j\} = \text{Perm}_A \{ho_i\}$ $i = 1, 2, \ldots k_1$ for $$j = mk_1+1, \ldots (m+1)k_1 \tag{10}$$

where m is an integer. The permutations can be a function of the variable m (the group index). Note that in general, the last group will not be complete if the number of harmonics is not a multiple of $k_1$. The permutations could be either randomly, deterministically, or heuristically defined for each speech frame using well known techniques.

Calculators 211 and 212 produce one value for the fundamental frequency and each of the harmonic frequencies. This value is assumed to be located in the center of a speech frame that is being synthesized. The remaining per-sample frequencies for each sample in the frame are obtained by linearly interpolating between the frequencies of adjacent voiced frames or predetermined boundary conditions for adjacent unvoiced frames. This interpolation is performed in sinusoidal generator 214 and is described in subsequent paragraphs.

Harmonic amplitude calculator 213 is responsive to the frequencies calculated by calculators 211 and 212, the LPC coefficients received via path 216, and the frame energy, eo, received via path 220 to calculate the harmonic amplitudes. The LPC reflection coefficients for each voiced frame define an acoustic tube model representing the vocal tract during each frame. The relative harmonic amplitudes can be determined from this information. However, since the LPC coefficients are modeling the structure of the vocal tract they do not contain information with respect to the amount of energy at each of these harmonic frequencies. This information is determined by calculator 213 using the frame energy received via path 220. For each frame, calculator 213 calculates the harmonic amplitudes which, like the frequency calculations, assumes that this amplitude is located in the center of the frame. Linear interpolation is then used to determine the remaining amplitudes throughout the frame by using amplitude information from adjacent voiced frames or predetermined boundary conditions for adjacent unvoiced frames.

These amplitudes can be found by recognizing that the vocal tract can be described by an all-pole filter, $$G(z) = \frac{1}{A(z)}, \tag{11}$$

where $$A(z) = \sum_{m=0}^{10} a_m z^{-m}. \tag{12}$$

By definition, the coefficient $a_0$ equals 1. The coefficients $a_m$, $1 \leqq m \leqq 10$, necessary to describe the all-pole filter can be obtained from the reflection coefficients received via path 216 by using the recursive step-up procedure described in Markel, J. D., and Gray, Jr., A. H., *Linear Prediction of Speech,* Springer-Berlag, New York, N.Y., 1976. The filter described in equations 11 and 12 is used to compute the amplitudes of the harmonic components for each frame in the following manner. Let the harmonic amplitudes to be computed be designated as $ha_i$, $0 \leqq i \leqq h$ where h is the number of harmonics. An unscaled harmonic contribution value, $he_i$, $0 \leqq i \leqq h$, can be obtained for each harmonic frequency, $hf_i$, by $$he_i = \frac{1}{\left| \sum_{m=0}^{10} a_m e^{-j(2\pi/sr)mhf_i} \right|^2},\ 0 \leqq i \leqq h, \tag{13}$$

where sr is the sampling rate. The total unscaled energy of all harmonics, E, can be obtained by $$E = \sum_{i=0}^{h} he_i. \tag{14}$$

By assuming that $$\sum_{n=0}^{179} \frac{s_n^2}{180} = \sum_{i=0}^{h} \frac{ha_i^2}{2}, \tag{15}$$

it follows that the ith scaled harmonic amplitude, $ha_i$, can be computed by $$ha_i = \frac{eo}{\sqrt{90}} \left| \frac{he_i}{E} \right|^{\frac{1}{2}}, 0 \leqq i \leqq h, \tag{16}$$

where eo is the transmitted speech frame energy calculated by analyzer 100.

Now consider how sinusoidal generator 214 utilizes the information received from calculators 211, 212, and 213 to perform the calculations indicated by equation 1. For a given frame, calculators 211, 212, and 213 provide to generator 214 a single frequency and amplitude for each harmonic in that frame. Generator 214 performs the linear interpolation for both the frequencies and amplitudes and converts the frequency information to phase information so as to have phases and amplitudes for each sample point throughout the frame.

Figure 7:
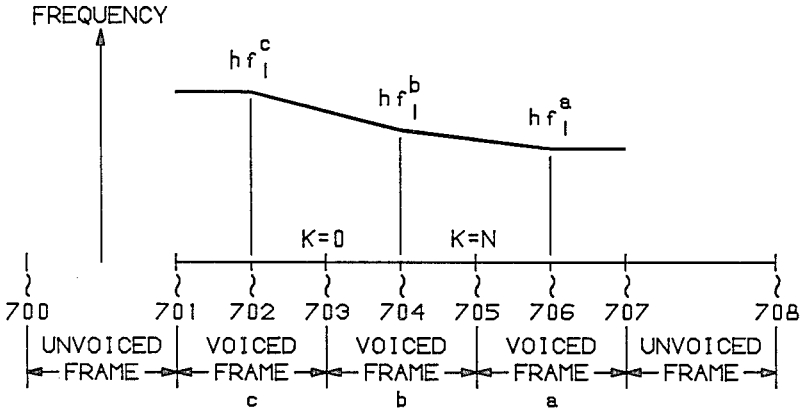
FIG. 7 illustrates, in graph form, the interpolation performed by the synthesizer of FIG. 2 for the fundamental and harmonic frequencies.

The linear interpolation is performed in the following manner. FIG. 7 illustrates 5 speech frames and the linear interpolation that is performed for the fundamental frequency which is also considered to be the 0th harmonic frequency. For the other harmonics, there would be a similar representation. In general, there are three boundary conditions that can exist for a voiced frame. First, the voiced frame can have a preceding unvoiced frame and a subsequent voiced frame. Second, the voiced frame can be surrounded by other voiced frames. Third, the voiced frame can have a preceding voice frame and a subsequent unvoiced frame. As illustrated in FIG. 7, frame c, points 701 through 703, represent the first condition; and the frequency $hf_i^c$ is assumed to be constant from the beginning of the frame which is defined by 701. For the fundamental frequency, i is equal to 0. The c refers to the fact that this is the c frame. Frame b, which is after frame c and defined by points 703 through 705, represents the second case; and linear interpolation is performed between points 702 and 704 utilizing frequencies $hf_i^c$ and $hf_i^b$ which occur at points 702 and 704, respectively. The third condition is represented by frame a which extends from points 705 through 707, and the frame following frame a is an unvoiced frame, points 707 to 708. In this situation the harmonic frequencies, $hf_i^a$, are constant to the end of frame a at point 707.

Figure 8:
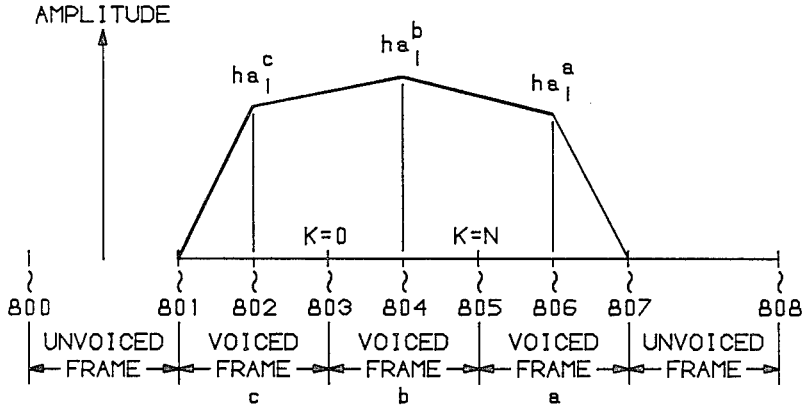
FIG. 8 illustrates, in graph form, the interpolation performed by the synthesizer of FIG. 2 for amplitudes of the fundamental and harmonic frequencies.
Figure 9:
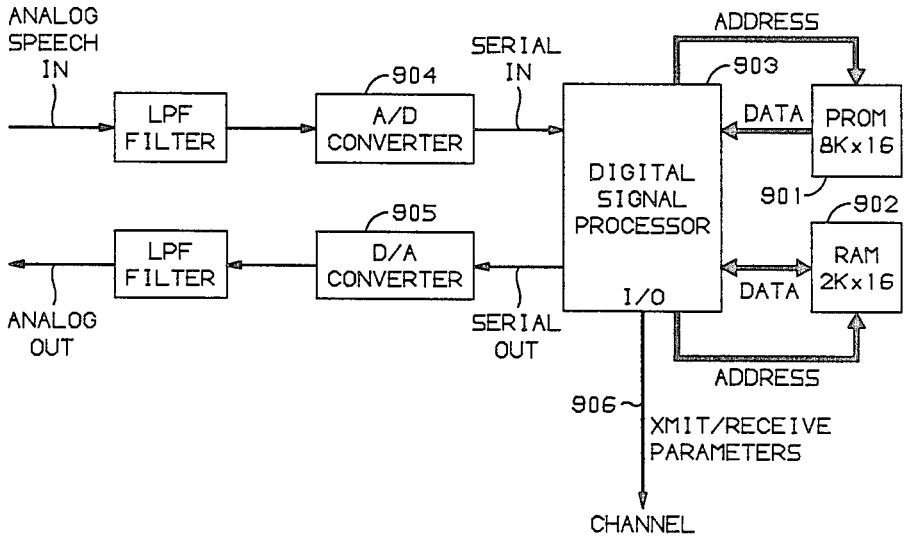
FIG. 9 illustrates a digital signal processor implementation of FIGS. 1 and 2.

FIG. 8 illustrates the interpolation of amplitudes. For consecutive voiced frames such as defined by frames c and b, the interpolation is identical to that performed with respect to the frequencies. However, when the previous frame is unvoiced, such as is the relationship of frame c to frame 800 through 801, then the start of the frame is assumed to have 0 amplitude as illustrated at the point 801. Similarly, if a voiced frame is followed by an unvoiced frame, such as illustrated by frame a and frame 807 and 808, then the end point, such as point 807, is assumed to have 0 amplitude.

Generator 214 performs the above described interpolation using the following equations. The per-sample phases of the nth sample, where $O_{n,i}$ is the per-sample phase of the ith harmonic, are defined by $$O_{n,i} = O_{n-1,i} + \frac{2 * W_{n,i}}{sr}, 0 \leqq i \leqq h, \tag{17}$$

where sr is the output sample rate. It is only necessary to know the per-sample frequencies, $W_{n,i}$, to solve for the phases and these per-sample frequencies are found by doing interpolation. The linear interpolation of frequencies for voiced frame with adjacent voiced frames such as frame b of FIG. 7 is defined by $$W_{n,i}^b = W_{n-1,i}^b + \frac{hf_i^a - hf_i^b}{180}, 90 \leqq n \leqq 179, 0 \leqq i \leqq h_{min}, \tag{18}$$

and $$W_{n,i}^b = W_{n-1,i}^b + \frac{hf_i^b - hf_i^c}{180}, 0 \leqq n \leqq 89, 0 \leqq i \leqq h_{min}, \tag{19}$$

where $h_{min}$ is the minimum number of harmonics in either adjacent frame. The transition from an unvoiced to a voiced frame, such as frame c, is handled by determining the per-sample harmonic frequency by $$W_n^{ci}, = hf_i^c, 0 \leqq n \leqq 89. \tag{20}$$

The transition from a voiced frame to an unvoiced frame, such as frame a, is handled by determining the per-sample harmonic frequencies by $$W_n^{ai}, = hf_i^a, 90 \leqq n \leqq 179. \tag{21}$$

If $h_{min}$ represents the minimum number of harmonics in either of two adjacent frames, then, for the case where frame b has more harmonics than frame c, equation 20 is used to calculate the per-sample harmonic frequencies for harmonics greater than $h_{min}$. If frame b has more harmonics than frame a, equation 21 is used to calculate the per-sample harmonics frequency for harmonics greater than $h_{min}$.

The per-sample harmonic amplitudes, $A_{n,i}$, can be determined from $ha_i$ in a similar manner as defined by the following equations for voiced frame b.

$$A_{n,i}^b = A_{n-1,i}^b + \frac{ha_i^a - ha_i^b}{180}, 90 \leqq n \leqq 179, 0 \leqq i \leqq h_{min}, \tag{22}$$

and $$A_{n,i}^b + A_{n-1,i}^b + \frac{ha_i^b - ha_i^c}{180}, 0 \leqq n \leqq 89, 0 \leqq i \leqq h_{min}. \tag{23}$$

When a frame is the start of a voiced region such as at the beginning of frame c, the per-sample harmonics amplitude are determined by $$A_{0,i}^c = 0, 0 \leqq i \leqq h, \tag{24}$$

and $$A_{n,i}^c = A_{n-1,i}^c = \frac{ha_i^c}{90}, 1 \leqq n \leqq 89, 0 \leqq i \leqq h, \tag{25}$$

where h is the number of harmonics in frame c. When a frame is the end of a voiced region such as frame a, the per-sample amplitudes are determined by $$A^a_{n,i} = A^a_{n-1,i} - \frac{ha_i^a}{90}, \; 90 \leqq n \leqq 179, \; 0 \leqq i \leqq h, \tag{26}$$

where h is number of harmonics in frame a. For the case where a frame such as frame b has more harmonics than the preceding voiced frame, such as frame c, equations 24 and 25 are used to calculate the harmonic amplitudes for the harmonics greater than $h_{min}$. If frame b has more harmonics than frame a, equation 18 is used to calculate the harmonic amplitude for the harmonics greater than $h_{min}$.

Figure 10:
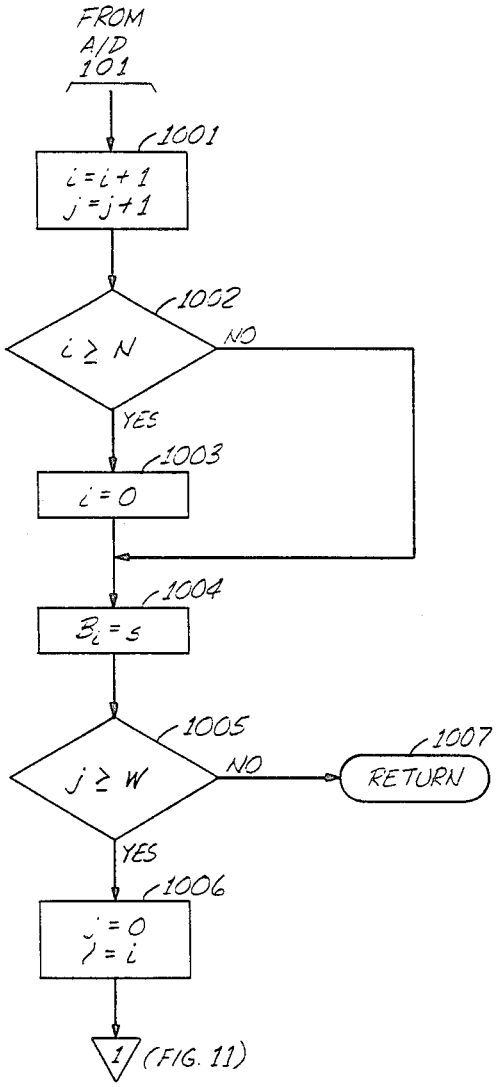
FIGS. 10 through 13 illustrate, in flowchart form, a program for controlling signal processor 903 of FIG. 9 to allow implementation of the analyzer circuit of FIG. 1.
Figure 11:
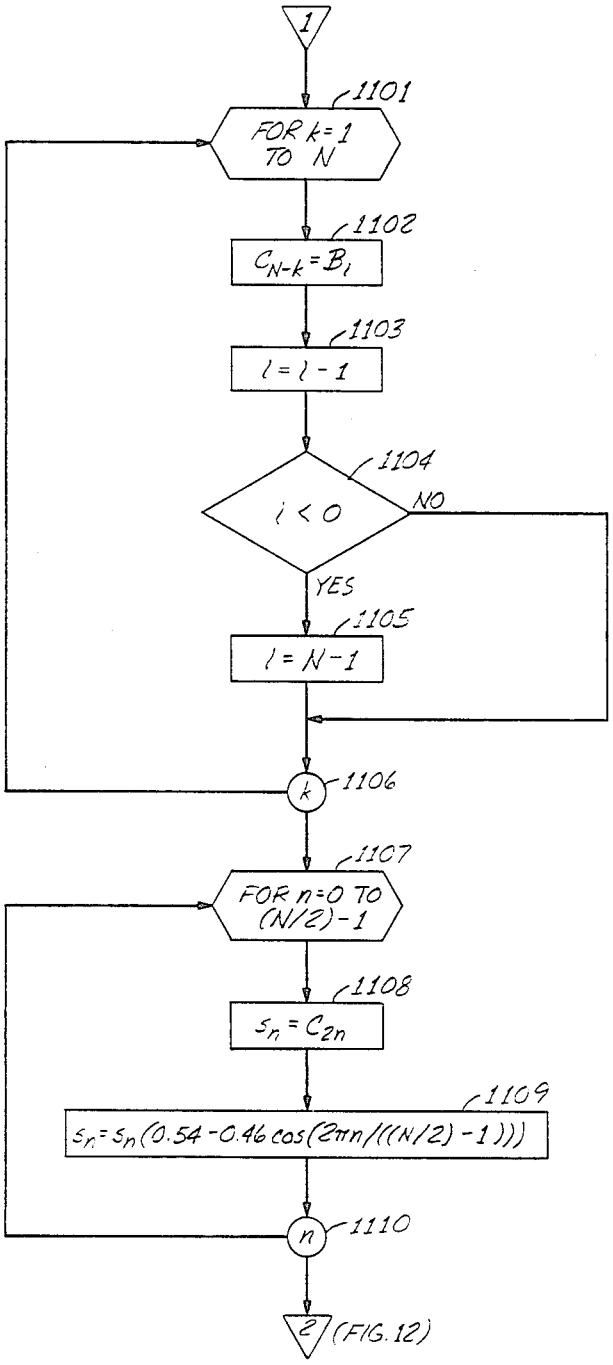

Consider now in greater detail the analyzer illustrated in FIG. 1. FIGS. 10 and 11 show the steps necessary to implement the frame segmenter 141 of FIG. 1. As each sample, s, is received from A/D block 101, segmenter 141 stores each sample into a circular buffer B. Blocks 1001 through 1005 continue to store the sample into circular buffer B utilizing the i index. Decision block 1002 determines when the end of circular buffer B has been reached by comparing i against N which defines the end of the buffer and also N is the number of points in the spectral analysis. Advantageously, N is equal to 256, and W is equal to 180. When i exceeds the end of the circular buffer, i is set to 0 by block 1003 and then, the samples are stored starting at the beginning of circular buffer B. Decision block 1005 counts the number of samples being stored in circular buffer B; and when advantageously 180 samples as defined by W have been stored, designating a frame, block 1006 is executed; otherwise 1007 is executed, and the steps illustrated in FIG. 10 simply wait for the next sample from block 101. When 180 points have been received, blocks 1006 through 1106 of FIGS. 10 and 11 transfer the information from circular buffer B to array C, and the information in array C then represents one of the segments illustrated in FIG. 6.

Downsampler 142 and Hamming Window block 143 are implemented by blocks 1107 through 1110 of FIG. 11. The downsampling performed by block 142 is implemented by block 1108; and the Hamming windowing function, as defined by equation 2, is performed by block 1109. Decision block 1107 and connector block 1110 control the performance of these operations for all of the data points stored in array C.

Figure 12:
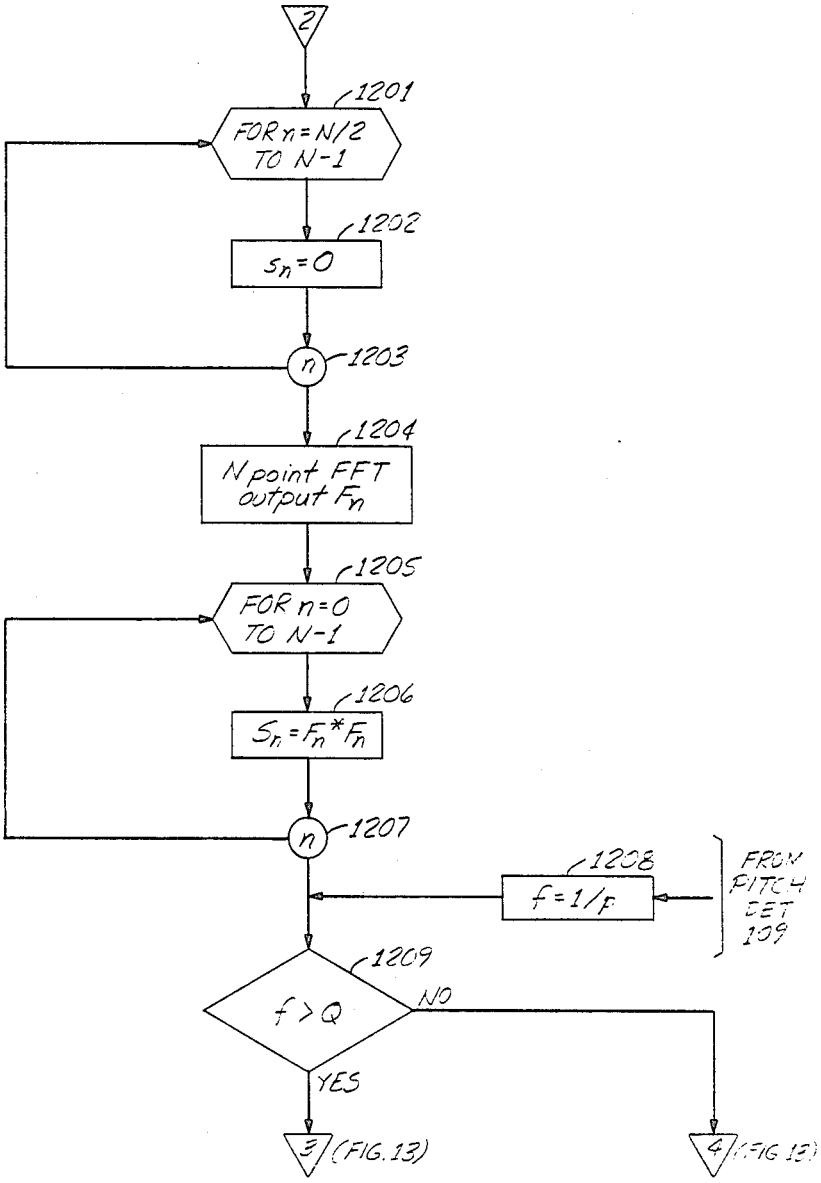

Blocks 1201 through 1207 of FIG. 12 implement the functions of FFT spectrum magnitude block 144. The zero padding, as defined by equation 3, is performed by blocks 1201 through 1203. The implementation of the fast Fourier transform on the resulting data points from blocks 1201 through 1203 is performed by 1204 giving the same results as defined by equation 4. Blocks 1205 through 1207 are used to obtain the spectrum defined by equation 5.

Figure 13:
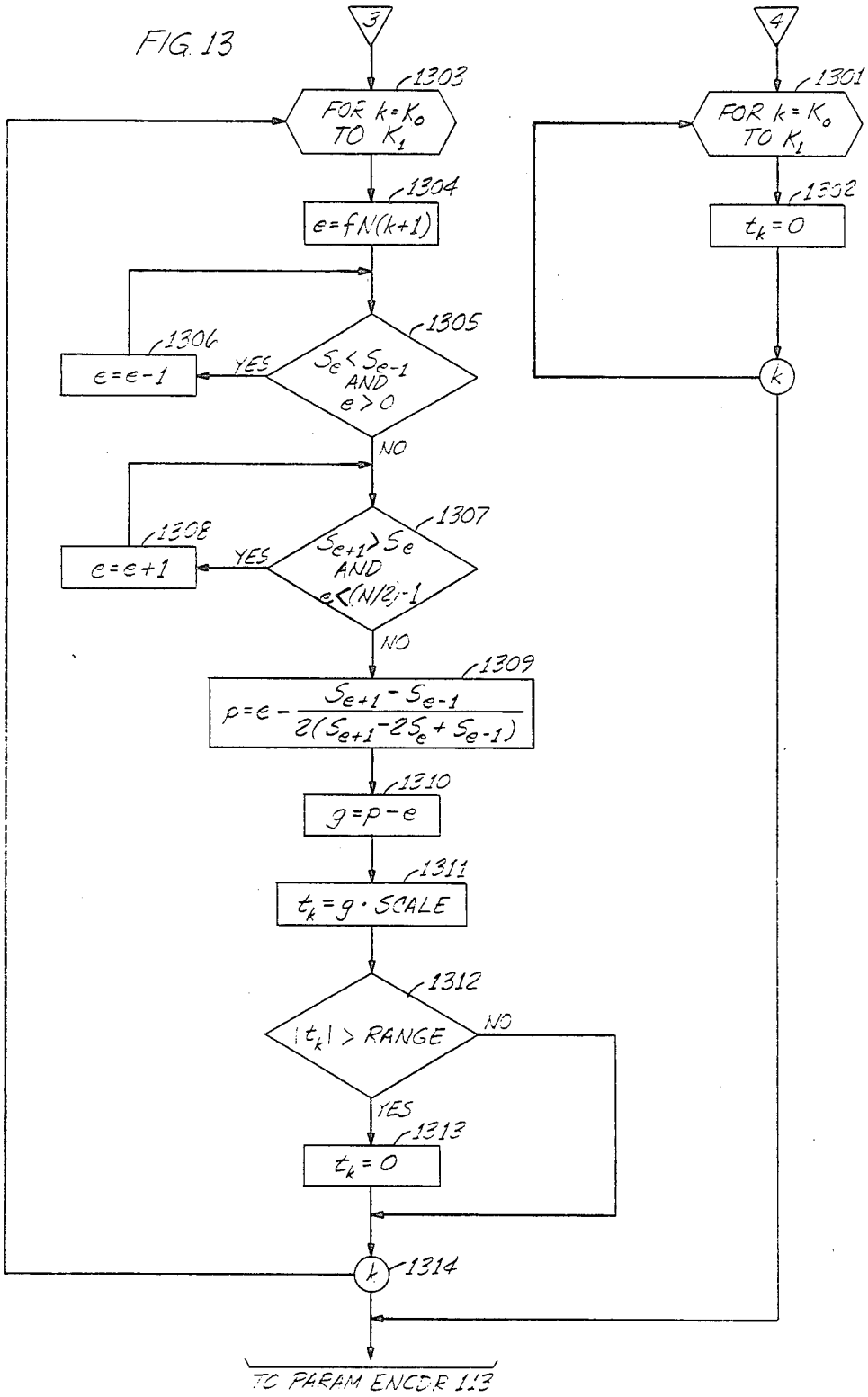

Blocks 145, 146 and 147 of FIG. 1 are implemented by the steps illustrated by blocks 1208 through 1314 of FIGS. 12 and 13. The pitch period received from pitch detector 109 via path 131 of FIG. 1 is converted to the fundamental frequency, Fr, by block 1208. This conversion is performed by both harmonic peak locator 145 and harmonic calculator 147. If the fundamental frequency is less than or equal to a predefined frequency, Q, which advantageously may be 60 Hz, then decision block 1209 passes control to blocks 1301 and 1302 which set the harmonic offsets equal to 0. If the fundamental frequency is greater than the predefined value Q, then control is passed by decision block 1209 to decision block 1303. Decision block 1303 and connector block 1314 control the calculation of the subset of harmonic offsets which advantageously may be for harmonics 1 through 5. The initial harmonic defined by $K_0$, which is set equal to 1, and the upper harmonic value defined by $K_1$, which is set equal to 5. Block 1304 determines the initial estimate of where the harmonic presently being calculated will be found within the spectrum, S. Blocks 1305 through 1308 search and find the location of the peak associated with the present harmonic being calculated. These latter blocks implement harmonic peak locator 145. After the peak has been located, block 1309 performs the harmonic interpolation functions of block 146.

Harmonic calculator 147 is implemented by blocks 1310 through 1313. First, the unscaled offset for the harmonic currently being calculated is obtained by the execution of block 1310. Then, the results of block 1310 are scaled by 1311 so that an integer number is obtained. Decision block 1312 checks to make certain that the offset is within a predefined range to prevent an erroneous harmonic peak having been located. If the calculated offset is greater than the predefined range, the offset is set equal to 0 by execution of block 1313. After all the harmonic offsets have been calculated, control is passed to parameter encoder 113 of FIG. 1.

FIGS. 14 through 19 detail the steps executed by processor 803 in implementing synthesizer 200 of FIG. 2. Harmonic frequency calculators 212 and 211 of FIG. 2 are implemented by blocks 1418 through 1424 of FIG. 14. Block 1418 initializes the parameters to be utilized in this operation. Blocks 1419 through 1420 initially calculate each of the harmonic frequencies, $hf_k^i$, by multiplying the fundamental frequency, which is obtained as the transmitted pitch, times k+1. After all of the theoretical harmonic frequencies have been calculated, the scaled transmitted offsets are added to the first five theoretical harmonic frequencies by blocks 1421 through 1424. The constants $k_0$ and $k_1$ are set equal to "1" and "5", respectively, by block 1421.

Figure 14:
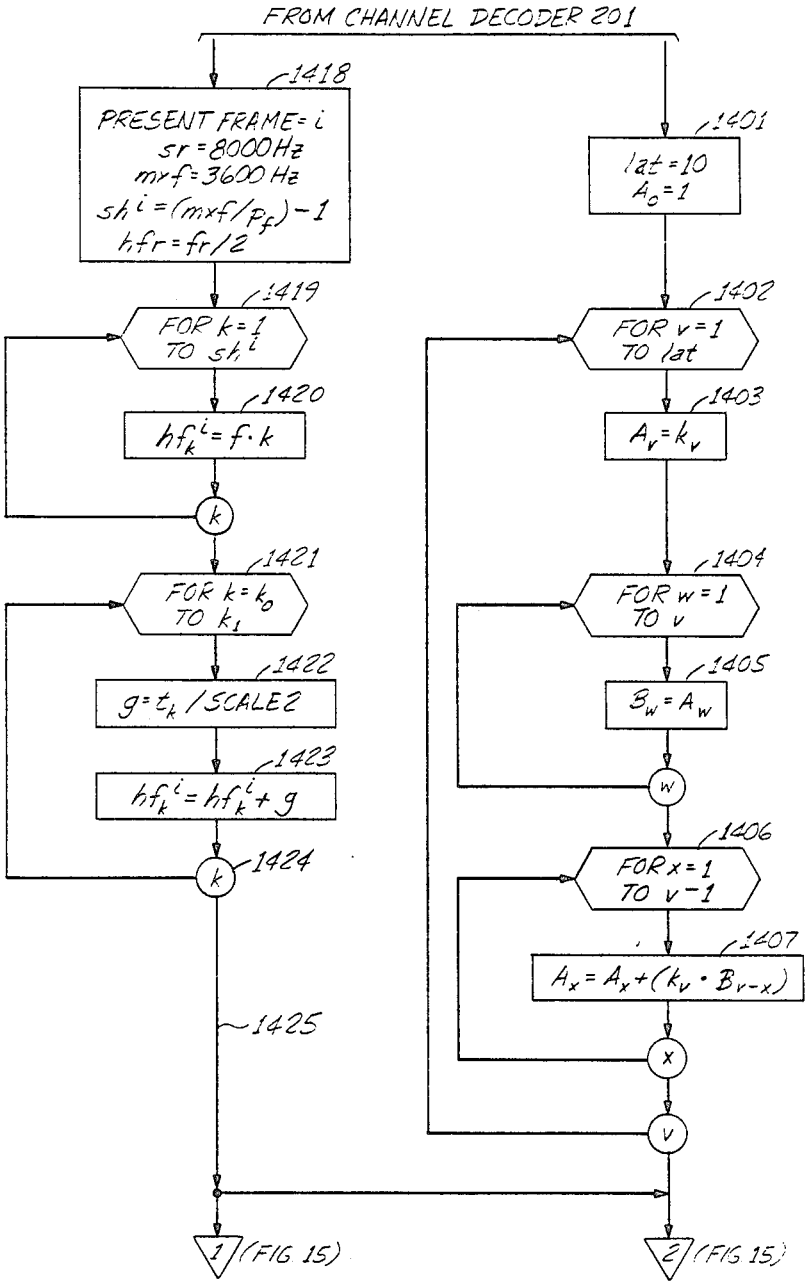
FIGS. 14 through 19 illustrate, in flowchart form, a program to control the execution of digital signal processor 903 of FIG. 9 to allow implementation of the synthesizer of FIG. 2.
Figure 15:
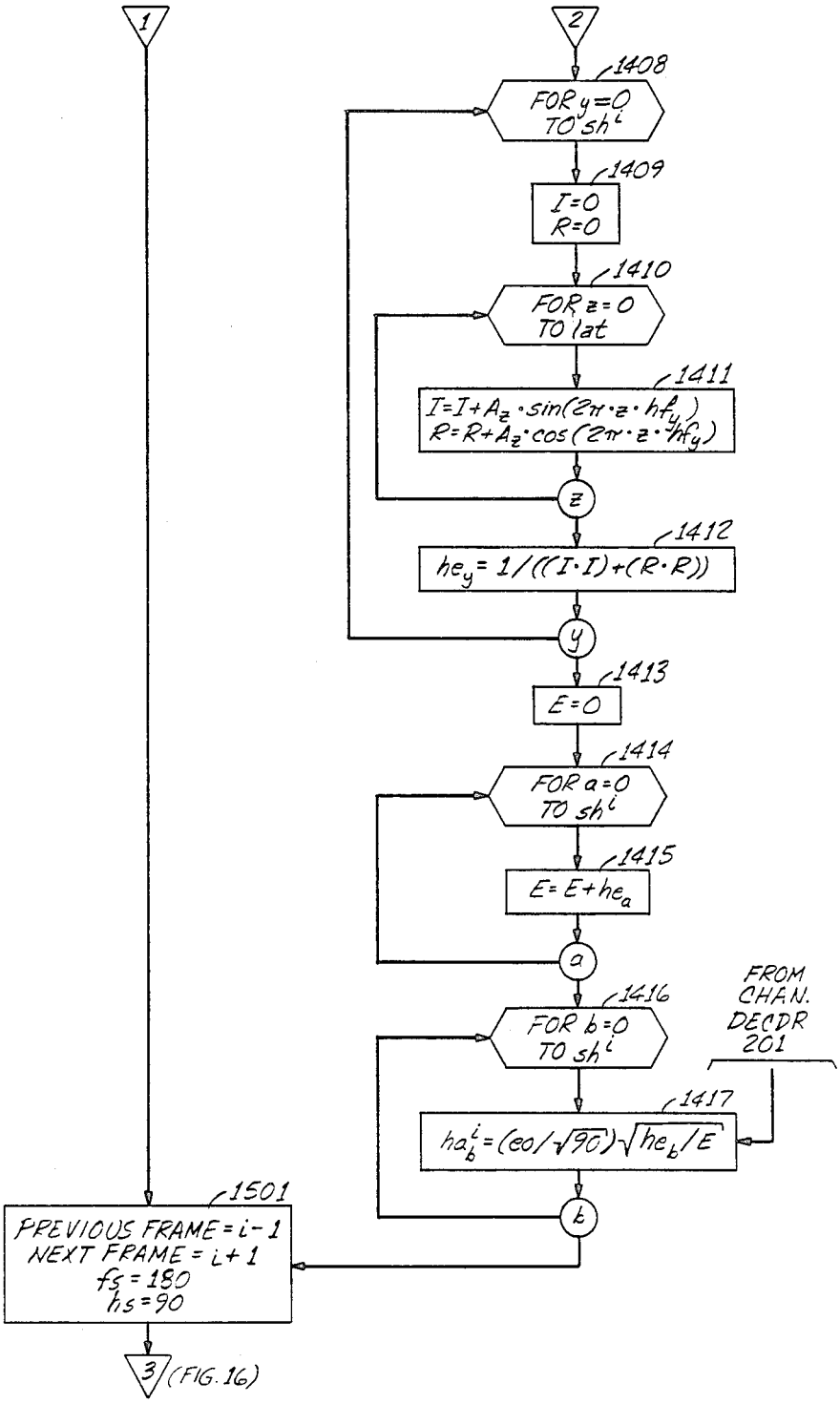

Harmonic amplitude calculator 213 is implemented by processor 803 of FIG. 8 executing blocks 1401 through 1417 of FIGS. 14 and 15. Blocks 1401 through 1407 implement the step-up procedure in order to convert the LPC reflection coefficients for the all-pole filter description of the vocal tract which is given in equation 11. Blocks 1408 through 1412 calculate the unscaled harmonic energy for each harmonic as defined in equation 13. Blocks 1413 through 1415 are used to calculate the total unscaled energy, E, as defined by equation 14. Blocks 1416 and 1417 calculate the ith frame scaled harmonic amplitude, $ha_b^i$ defined by equation 16.

Blocks 1501 through 1521 and blocks 1601 through 1614 of FIGS. 15 through 18 illustrate the operations which are performed by processor 803 in doing the interpolation for the frequency and amplitudes for each of the harmonics as illustrated in FIGS. 7 and 8. These operations are performed by the first part of the frame being processed by blocks 1501 through 1521 and the second part of the frame being processed by blocks 1601 through 1614. As illustrated in FIG. 7, the first half of frame c extends from point 701 to 702, and the second half of frame c extends from point 702 to 703. The operation performed by these blocks is to first determine whether the previous frame was voiced or unvoiced.

Specifically block 1501 of FIG. 15 sets up the initial values. Decision block 1502 makes the determination of whether the previous frame had been voiced or unvoiced. If the previous frame had been unvoiced, then decision blocks 1504 through 1510 are executed. Blocks 1504 and 1507 of FIG. 17 initialize the first data point for the harmonic frequencies and amplitudes for each harmonic at the beginning of the frame to $hf_c^i$ for the phases and $a_{0,c}^i=0$ for the amplitudes. This corresponds to the illustrations in FIGS. 7 and 8. After the initial values for the first data points of the frame are set up, the remaining values for a previous unvoiced frame are set by the execution of blocks 1508 through 1510. For the case of the harmonic frequency, the frequencies are set equal to the center frequency as illustrated in FIG. 7. For the case of the harmonic amplitudes each data point is set equal to the linear approximation starting from zero at the beginning of the frame to the midpoint amplitude, as illustrated for frame c of FIG. 8.

Figure 16:
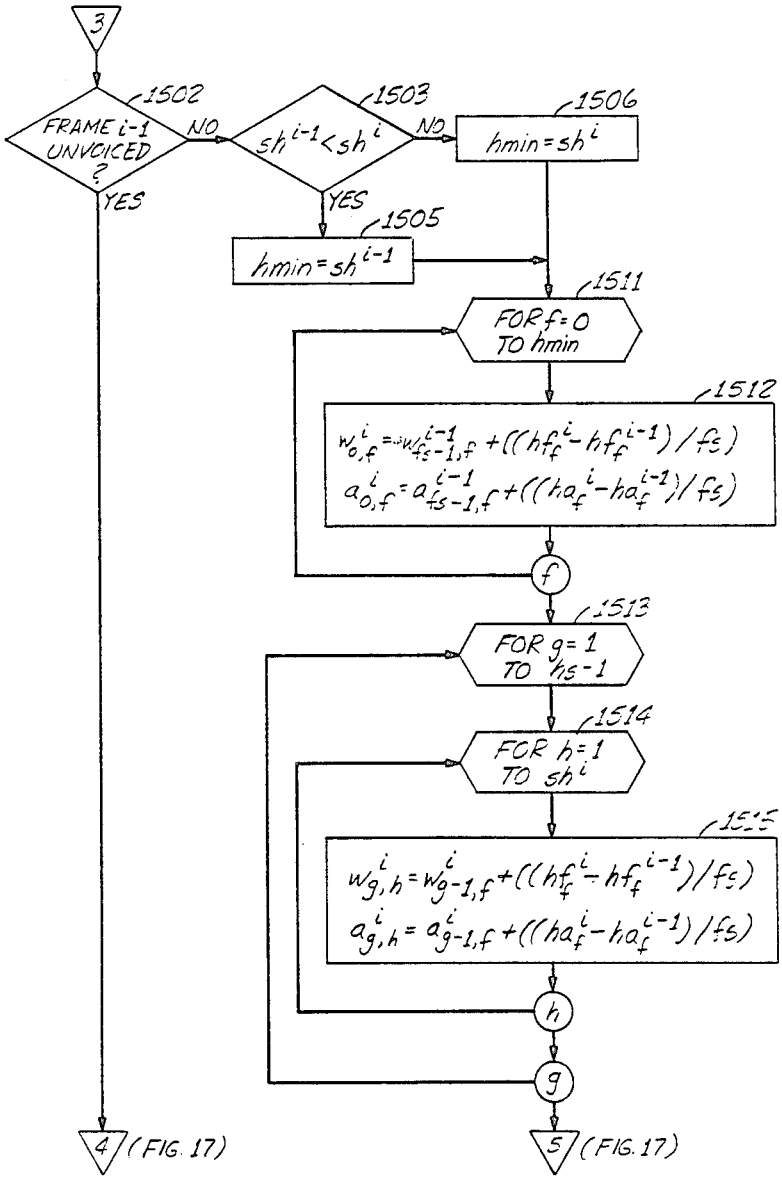
Figure 17:
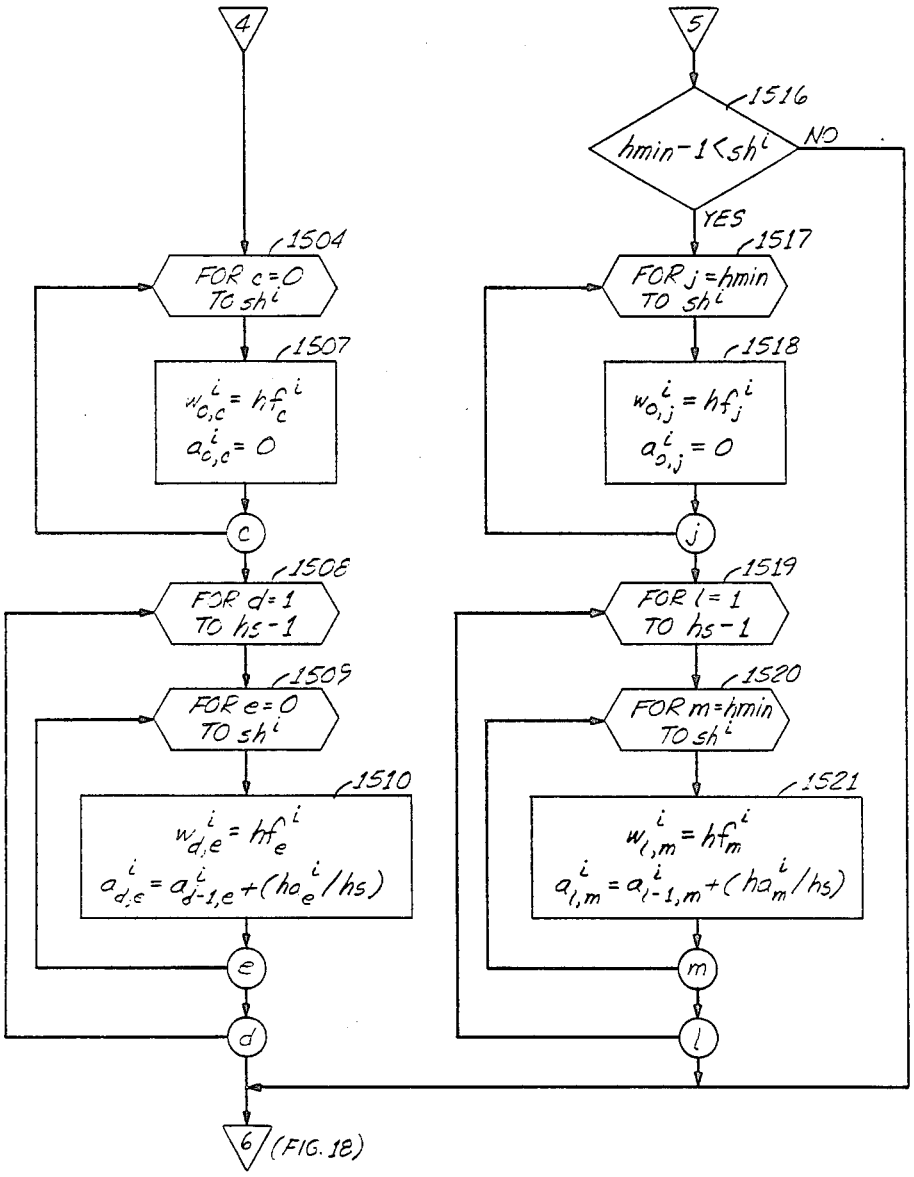
Figure 18:
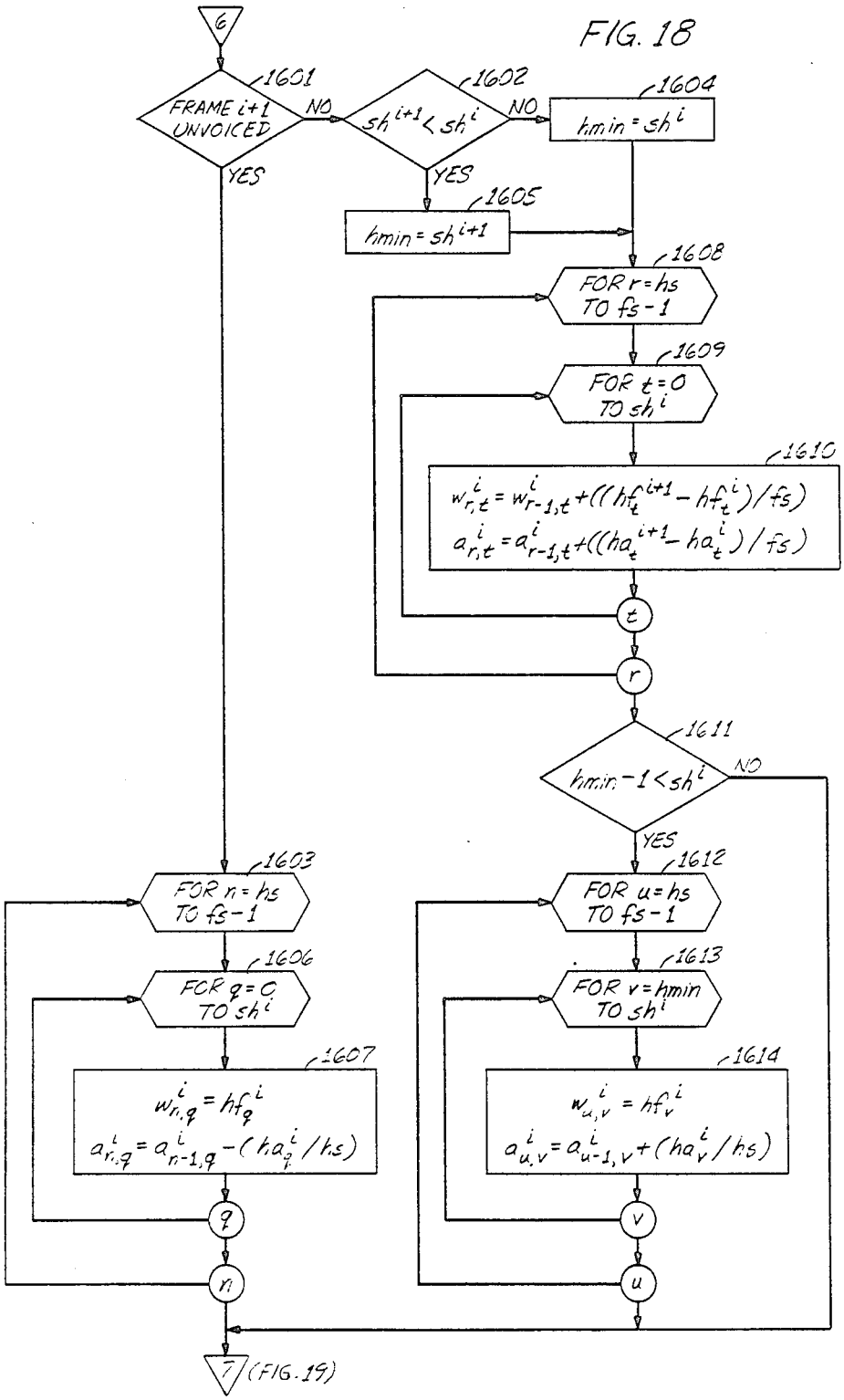
Figure 19:
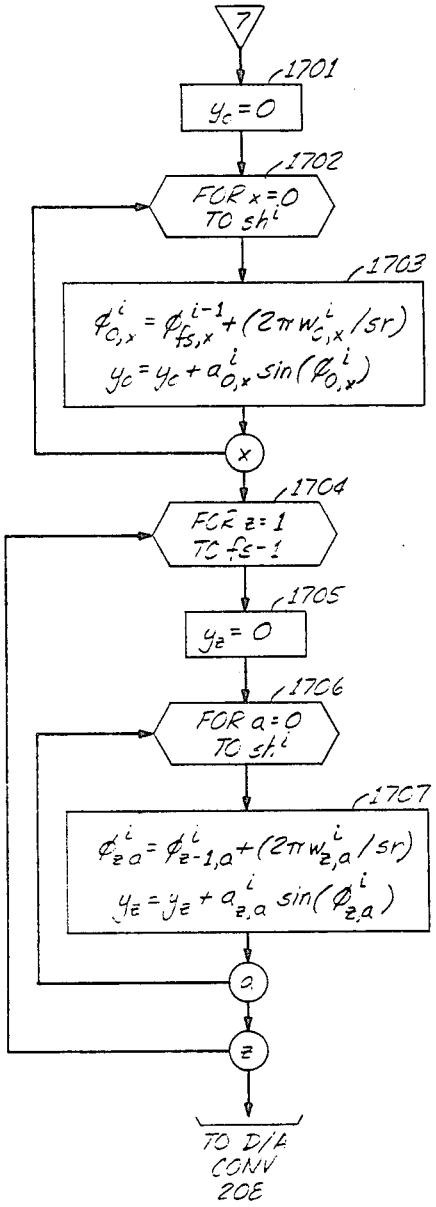

If the decision is made by block 1502 that the previous frame was voiced, then decision block 1503 of FIG. 16 is executed. Decision block 1503 determines whether the previous frame had more or less harmonics than the present frame. The number of harmonics is indicated by the variable, sh. Depending on which frame has the most harmonics determines whether blocks 1505 or 1506 is executed. The variable, hmin, is set equal to the least number of harmonic of either frame. After either block 1505 or 1506 has been executed, blocks 1511 and 1512 are executed. The latter blocks determine the initial point of the present frame by calculating the last point of the previous frame for both frequency and amplitude. After this operation has been performed for all harmonics, blocks 1513 through 1515 calculate each of the per-sample values for both the frequencies and the amplitudes for all of the harmonics as defined by equation 22 and equation 26, respectively.

After all of the harmonics, as defined by variable hmin have had their per-sample frequencies and amplitudes calculated, blocks 1516 through 1521 are calculated to account for the fact that the present frame may have more harmonics than than the previous frame. If the present frame has more harmonics than the previous frame, decision block 1516 transfers control to blocks 1517. Where there are more harmonics in the present frame than the previous frames, blocks 1517 through 1521 are executed and their operation is identical to blocks 1504 through 1510, as previously described.

The calculation of the per-sample points for each harmonic for frequency and amplitudes for the second half of the frame is illustrated by blocks 1601 through 1614. The decision is made by block 1601 whether the next frame is voiced or unvoiced. If the next frame is unvoiced, blocks 1603 through 1607 are executed. Note, that it is not necessary to determine initial values as was performed by blocks 1504 and 1507, since the initial point is the midpoint of the frame for both frequency and amplitudes. Blocks 1603 through 1607 perform similar functions to those performed by blocks 1508 through 1510. If the next frame is a voiced frame, then decision block 1602 and blocks 1604 or 1605 are executed. The execution of these blocks is similar to that previously described for blocks 1503, 1505, and 1506. Blocks 1608 through 1611 are similar in operation to blocks 1513 through 1516 as previously described. Note, that it is not necessary to set up the initial conditions for the second half of the frame for the frequencies and amplitudes. Blocks 1612 through 1614 are similar in operation to blocks 1519 through 1521 as previously described.

The final operation performed by generator 214 is the actual sinusoidal construction of the speech utilizing the per-sample frequencies and amplitudes calculated for each of the harmonics as previously described. Blocks 1701 through 1707 of FIG. 19 utilize the previously calculated frequency information to calculate the phase of the harmonics from the frequencies and then to perform the calculation defined by equation 1. Blocks 1702 and 1703 determine the initial speech sample for the start of the frame. After this initial point has been determined, the remainder of speech samples for the frame are calculated by blocks 1704 through 1707. The output from these blocks is then transmitted to digital-to-analog converter 208.

Figure 20:
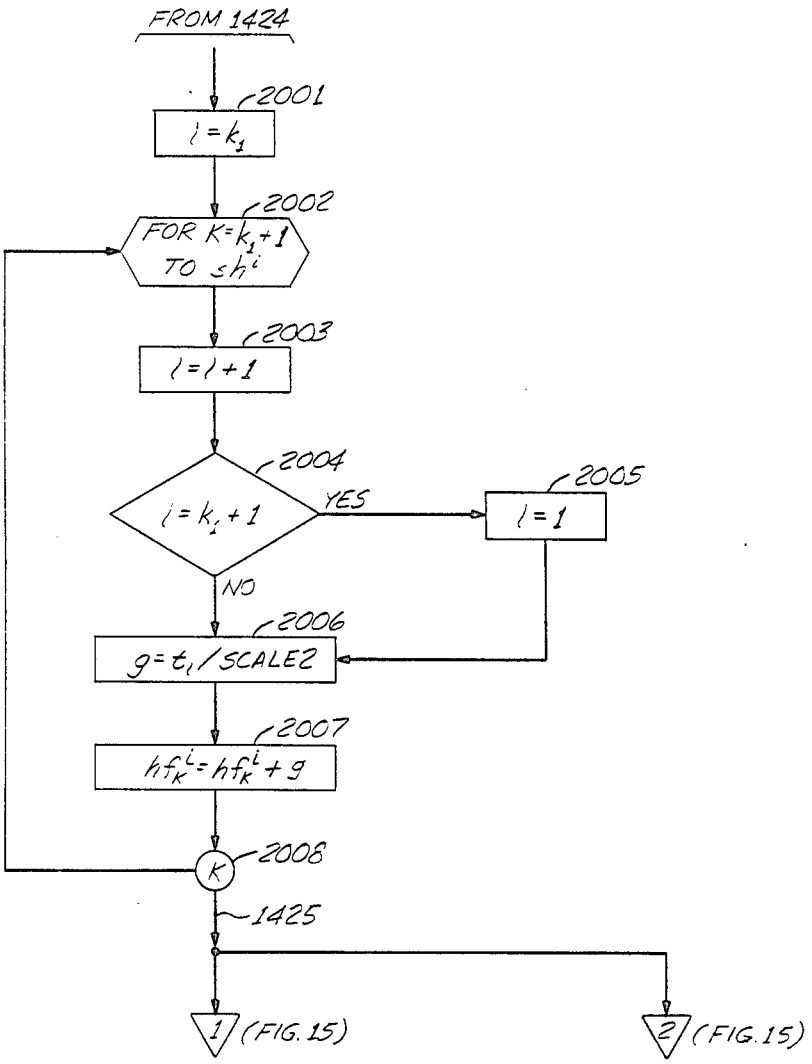
FIGS. 20, 21, and 22 illustrate, in flowchart form, other program routines to control the execution of digital signal processor 903 of FIG. 9 to allow the implementation of high harmonic frequency calculator 211 of FIG. 2.

Another embodiment of calculator 211 reuses the transmitted harmonic offsets to vary the calculated theoretical harmonic frequencies for harmonics greater than 5 and is illustrated in FIG. 20. Blocks 2003 through 2005 are used to group the harmonics above the 5th harmonic into groups of 5, and blocks 2006 and 2007 then add the corresponding transmitted harmonic offset to each of the theoretical harmonic frequencies in these groups.

Figure 21:
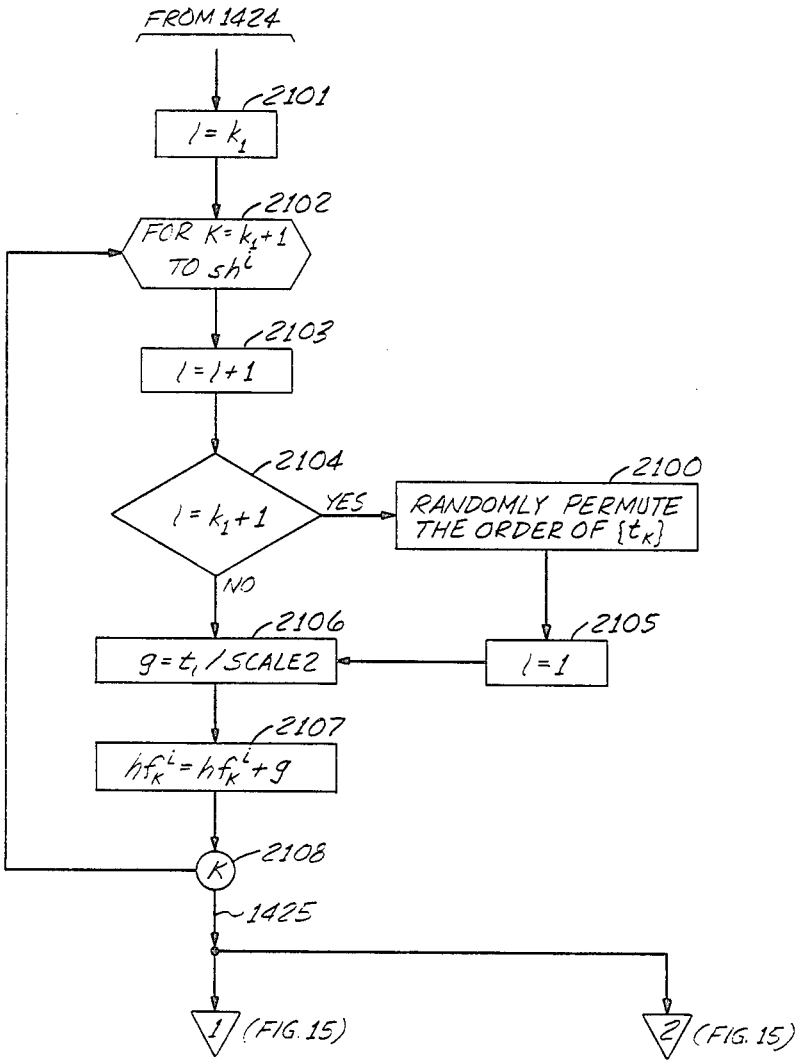

FIG. 21 illustrates a second alternate embodiment of calculator 211 which differs from the embodiment shown in FIG. 20 in that the order of the offsets is randomly permuted for each group of harmonic frequencies above the first five harmonics by block 2100. Blocks 2101 through 2108 of FIG. 21 perform similar functions to those of corresponding blocks of FIG. 20.

Figure 22:
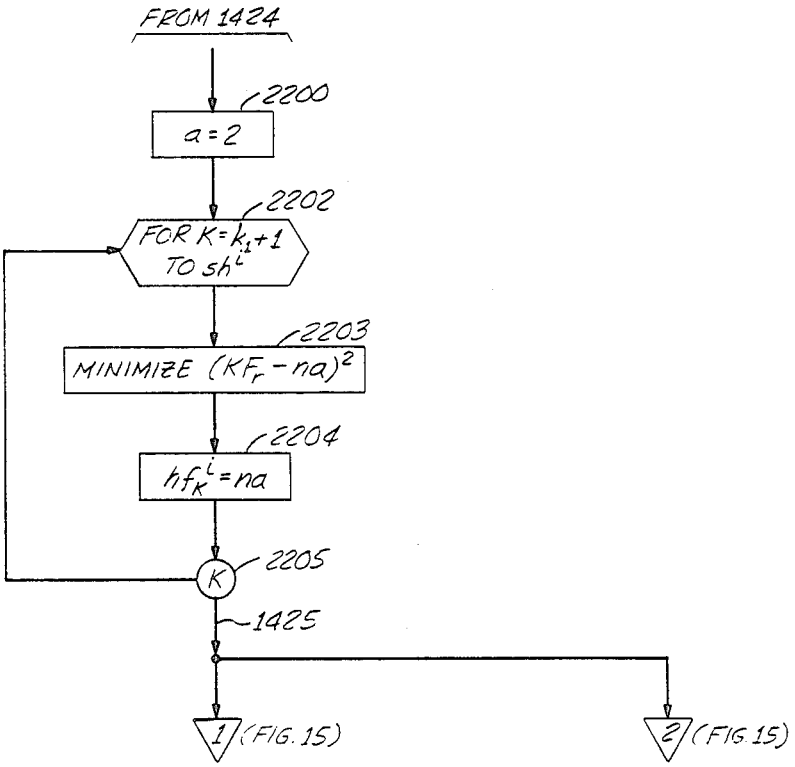

A third alternate embodiment is illustrate in FIG. 22. That embodiment varies the harmonic frequencies from the theoretical harmonic frequencies transmitted to calculator 213 and generator 214 of FIG. 2 by performing the calculations illustrated in blocks 2203 and 2204 for each harmonic frequency under control of blocks 2202 and 2205.

It is to be understood that the above-described embodiment is merely illustrative of the principles of the invention and that other arrangements may be devised by those skilled in the art without departing from the spirit and scope of the invention.

What is claimed is:

1. A processing system for synthesizing voice from encoded information representing speech frames each having a predetermined number of evenly spaced samples of instantaneous amplitude of speech with said encoded information for each frame representing frame energy and a set of speech parameters and a fundamental frequency signal of the speech and offset signals representing the difference between the theoretical harmonic frequencies as derived from a fundamental frequency signal and a subset of the actual harmonic frequencies, said system comprising:

means responsive to the offset signals and the fundamental frequency signal of one of said frames for calculating a subset of harmonic phase signals corresponding to said offset signals;

means responsive to said fundamental frequency signal for computing the remaining harmonic phase signals for said one of said frames;

means responsive to the frame energy and the set of speech parameters of said one of said frames for determining the amplitudes of said fundamental signal and said subset of said harmonic phase signals and said remaining harmonic phase signals; and means for generating replicated speech in response to said fundamental signal and said subset of said harmonic phase signals and said remaining harmonic phase signals and the determined amplitudes for said one of said frames.

2. The system of claim 1 wherein said computing means comprises means for multiplying each harmonic number with said fundamental frequency signal to generate a frequency for each of said remaining harmonic phase signals;

means for arithmetically varying the generated frequencies; and means responsive to the varied frequencies for calculating said remaining harmonic phase signals.

3. The system of claim 2 wherein said varying means comprises means for constraining an arithmetic signal generated by subtracting a variable signal multiplied by a first constant from the harmonic number multiplied by said fundamental frequency signal such that said arithmetic signal is less than a second constant; and means for subtracting said variable signal multiplied by said first constant from said harmonic number multiplied times said fundamental frequency signal for each of said remaining harmonic phase signals to generate said varied frequencies.

4. The system of claim 1 wherein said computing means comprises means for generating the remaining harmonic frequency signals corresponding to said remaining harmonic phase signals by multiplying said fundamental frequency signal by the harmonic number for each of said remaining harmonic phase signals;

means for grouping the multiplied frequency signals into a plurality of subsets, each having the same number of harmonics as said subset of harmonic phase signals; and means for adding each of said offset signals to the corresponding grouped frequency signals of each of said plurality of subsets to generate varied remaining harmonic frequency signals; and means for calculating said remaining harmonic phase signals from said varied harmonic frequency signals.

5. The system of claim 1 wherein said computing means comprises means for generating the remaining harmonic frequency signals corresponding to said harmonic phase signals by multiplying said fundamental signal by the harmonic number for each of said remaining harmonic phase signals;

means for grouping the multiplied frequency signals into a plurality of subsets, each having the same number of harmonics as said subset of harmonic phase signals:

means for permuting the order of said offset signals;

means for adding each of said permuted offset signals to the corresponding grouped frequency signal of each of said plurality of subsets to generate varied remaining harmonic frequency signals; and means for calculating said remaining harmonic phase signals from the varied remaining harmonic frequency signals.

6. The system of claim 1 wherein said determining means comprises means for calculating the unscaled energy of each of said harmonic phase signals from said set of speech parameters for said one of said frames;

means for summing said unscaled energy for all of said harmonic phase signals for said one of said frames; and means responsive to said harmonic energy of each of said harmonic signals and the summed unscaled energy and said frame energy for said one of said frames for computing the amplitudes of said harmonic phase signals.

7. The system of claim 1 wherein each of said harmonic phase signals comprises a plurality of samples and said calculating means comprises means for adding each of said offset signals to said fundamental signal to obtain the corresponding harmonic sample for each harmonic phase signals of said subset;

said computing means comprises means for generating a corresponding harmonic sample for each of said remaining harmonic phase signals; and means responsive to the corresponding harmonic sample for said one of said frames and the corresponding harmonic samples for the previous and subsequent ones of said frames for each of said harmonic phase signals for interpolating to obtain said plurality of harmonic samples for each of said harmonic phase signals for said one of said frames upon said previous and subsequent ones of said frames being voiced frames.

8. The system of claim 7 wherein the interpolating means performs a linear interpolation.

9. The system of claim 8 wherein said corresponding harmonic signal for said one of said frames for each of said harmonic phase signals is located in the center of said one of said frames.

10. The system of claim 9 wherein said interpolating means comprises a first means for setting a subset of said plurality of harmonic samples for each of said harmonic phase signals from each of said corresponding harmonic samples to the beginning of said frames equal to each of said corresponding harmonic samples upon said previous one of said frames being an unvoiced frame; and a second means for setting another subset of said plurality of harmonic samples for each of said harmonic phase signals from each of said corresponding harmonic samples to the end of said one of said frames equal to said corresponding harmonic sample for each of said harmonic phase signals upon said sequential one of said frames being an unvoiced frame.

11. The system of claim 10 each of said frames further encoded by a set of speech parameters and multipulse excitation information and a excitation type signal upon said one of said frames being unvoiced and said system further comprises;

means for synthesizing said one of said frames of speech utilizing said set of speech parameter signals and said noise-like excitation upon said excitation type signal indicating noise excitation; and said synthesizing means further responsive to said speech parameter signals and said multipulse excitation information to synthesize said one of said frames of speech utilizing said multipulse excitation information and said set of speech parameter signals upon said excitation type signal indicating multipulse.

12. The system of claim 11 wherein said synthesizing means further comprises means responsive to said set of parameter signals from said previous frames to initialize said synthesizing means upon said one of said frames being the first unvoiced frame of an unvoiced region.

13. The system of claim 12 wherein said generating means performs a sinusoidal synthesis to produce the replicated speech utilizing said harmonic phase signals and said determined amplitudes for said one of said frames.

14. A processing system for encoding human speech comprising:

means for segmenting the speech into a plurality of speech frames, each having a predetermined number of evenly spaced samples of instantaneous amplitudes of speech and each of which overlaps by a predefined number of samples with the previous and subsequent frames;

means for calculating a set of speech parameter signals defining a vocal tract for each frame;

means for calculating the frame energy per frame of the speech samples;

means for performing a spectral analysis of said speech samples of each frame to produce a spectrum for each frame;

means for detecting the fundamental frequency signal for each frame from the spectrum corresponding to each frame;

means for determining a subset of harmonic frequency signals for each frame from the spectrum corresponding to each frame;

means for determining offset signals representing the difference between each of said harmonic frequency signals and multiples of said fundamental frequency signal; and means for transmitting encoded representations of said frame energy and said set of speech parameters and said fundamental frequency signal and said offset signals for subsequent speech synthesis.

15. The system of claim 14 wherein said performing means comprises means for downsampling said speech samples thereby reducing the amount of computation.

16. The system of claim 15 further comprises means for designating frames as voiced and unvoiced;

means for transmitting a signal to indicate the use of noise-like excitation upon speech of said one of said frames resulting from noise-like source in the human larynx and said designating means indicating an unvoiced frame;

means for forming excitation information from a multipulse excitation source upon the absence of the noise-like source and upon said designating means indicating an unvoiced frame; and said transmitting means further responsive to said multipulse excitation information and said set of speech parameters for transmitting encoded representations of multipulse excitation information and said set of speech parameters for subsequent speech synthesis.

17. The system of claim 14 wherein said detecting means comprises means for identifying the peak corresponding to said fundamental frequency signal; and means for performing a second order interpolation around said peak to more accurately detect said fundamental frequency signal.

18. The system of claim 14 wherein said determining means comprises means for identifying the peaks each corresponding to one of said harmonic frequency signals; and means for performing a second order interpolation around each of said peaks to more accurately determine each of the corresponding harmonic frequency signals.

19. A method for synthesizing voice from encoded information representing speech frames each having a predetermined number of evenly spaced samples of instantaneous amplitude of speech with said encoded information for each frame comprising frame energy and a set of speech parameters and a fundamental frequency of speech and offset signals representing the difference between the theoretical harmonic frequencies as derived from a fundamental frequency signals and a subset of actual harmonic frequencies, comprising the steps of:

calculating a subset of harmonic phase signals corresponding to said offset signals;

computing the remaining harmonic phase signals for said one of said frames from said fundamental frequency signal;

determining the amplitudes of said fundamental signal and said subset of harmonic phase signals and said remaining harmonic phase signals from the frame energy and the set of speech parameters of said one of said frame; and generating replicated speech in response to said fundamental signal and said subset and remaining harmonic phase signals and said determined amplitudes for said one of said frames.

20. The method of claim 19 wherein said computing step comprises the steps of multiplying each harmonic number with said fundamental frequency signal to generate a frequency for each of said remaining harmonic phase signals;

arithmetically varying the generated frequencies; and calculating said remaining phase signals from said varied frequencies.

21. The method of claim 19 wherein said computing step comprises the step of generating the remaining harmonic frequency signals corresponding to said remaining harmonic phase signals by multiplying said fundamental frequency signal by the harmonic number for each of said remaining harmonic signals;

grouping the multiplied frequency signals into a plurality of subsets, each having the same number of harmonics as said subset of harmonic phase signal;

adding each of said offset signals to the corresponding grouped frequency signals of each of said plurality of subsets to generate varied remaining harmonic frequency signals; and calculating said remaining harmonic phase signals from said varied harmonic frequency signals.

22. The method of claim 21 wherein said step of adding comprises the step of permuting the order of said offset signals before adding said signals to said corresponding grouped frequency signals of each of said plurality of subsets to generate said varied remaining harmonic frequency signals.

23. The method of claim 19 wherein said determining step comprises the steps of calculating the unscaled energy of each of said harmonic phase signals from said set of speech parameters for said one of said frames;

summing said unscaled energy for all of said harmonic phase signals for said one of said frames; and computing the amplitudes of said harmonic phase signals in response to said harmonic energy of each of said harmonic signals and the summed unscaled energy and said frame energy for said one of said frames.

24. The method of claim 19 wherein each of said frames further encoded by a set of speech parameters and multipulse excitation information and an excitation type signal upon said one of said frames being unvoiced, and said method further comprising the steps of synthesizing said one of said frames of speech utilizing said set of speech parameter signals and noise like excitation upon said excitation type signal indicating noise excitation; and further synthesizing in response to said speech parameter signals and said multipulse excitation information to synthesize said one of said frames of speech using said multipulse excitation information and said set of speech parameter signals upon said excitation type signal indicating multipulse.

* * * * *

UNITED STATES PATENT AND TRADEMARK OFFICE

CERTIFICATE OF CORRECTION

PATENT NO. : 4,771,465

DATED : September 13, 1988

INVENTOR(S) : E.C. Bronson, W.T. Hartwell, T.E. Jacobs, R.H. Ketchum

It is certified that error appears in the above-identified patent and that said Letters Patent is hereby corrected as shown below:

Column 20, line 32, second occurrence of "step" should be --steps--.

Signed and Sealed this

Ninth Day of March, 1993

*Attest:*

STEPHEN G. KUNIN

*Attesting Officer*

*Acting Commissioner of Patents and Trademarks*